US009266657B2

(12) United States Patent
Baud et al.

(10) Patent No.: US 9,266,657 B2
(45) Date of Patent: Feb. 23, 2016

(54) RIGID CONTAINER FOR A FLEXIBLE POUCH FOR HOLDING A BIOPHARMACEUTICAL FLUID, ASSEMBLY COMPRISING SUCH A FLEXIBLE POUCH AND SUCH A CONTAINER, AND METHOD FOR USING SUCH A CONTAINER

(75) Inventors: Stephane Baud, La Bouilladisse (FR); Bastien Guillot, Aix en Provence (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 1122 days.

(21) Appl. No.: 13/322,481

(22) PCT Filed: May 25, 2010

(86) PCT No.: PCT/FR2010/051001

§ 371 (c)(1),
(2), (4) Date: Jan. 11, 2012

(87) PCT Pub. No.: WO2010/136714

PCT Pub. Date: Dec. 2, 2010

(65) Prior Publication Data

US 2012/0110960 A1 May 10, 2012

(30) Foreign Application Priority Data

May 27, 2009 (FR) ..... 09 53513

(51) Int. Cl.
*B65D 25/14* (2006.01)
*B65D 35/14* (2006.01)
(Continued)

(52) U.S. Cl.
CPC ..... *B65D 77/061* (2013.01); *B65D 85/68* (2013.01); *B65D 88/60* (2013.01); *B65D 90/046* (2013.01); *B65D 2585/6897* (2013.01); *B65D 2590/046* (2013.01)

(58) Field of Classification Search
CPC ..... B65B 2220/18; B65B 2220/16; B65D 77/065; B65D 81/245
USPC ..... 53/449, 173; 220/495.06, 220/495.01–495.03, 62.21, 611–614, 578; 222/105, 95, 386, 386.5–393; 100/211
See application file for complete search history.

(56) References Cited

U.S. PATENT DOCUMENTS 1,818,924 A * 8/1931 Basmadjian ..... 215/231
2,618,409 A * 11/1952 Eisenberger et al. ..... 222/95
(Continued)

FOREIGN PATENT DOCUMENTS

BE 539623 A 7/1955
EP 0 456 403 A1 11/1991
(Continued)

OTHER PUBLICATIONS

EPO translation of FR 0932321, Hubscher, Mar. 18, 1948.*
(Continued)

*Primary Examiner* — Stephen F Gerrity
*Assistant Examiner* — Eyamindae Jallow
(74) *Attorney, Agent, or Firm* — Young & Thompson

(57) ABSTRACT

The container includes a lower wall and an erect side wall limiting an upper opening of a housing for accommodating a flexible pouch containing a fluid; containment elements including a containment wall, the gap between its peripheral edge and the side wall being limited; the containment wall adapted to be applied against the pouch and held fixed in this position by holding elements arranged in the container and borne by the containment elements by a structural and functional combination, and being movable between an inactive retracted state and an active expanded state, in which a distal end part is either moved away from the side wall or applied there against without any chance of sliding; and adapted to be applied at any desired location of a zone of the side wall such that the containment wall can be applied and held against the pouch regardless of how full the latter is.

16 Claims, 24 Drawing Sheets

(51) Int. Cl.

| | |
|---|---|
| ***B30B 5/02*** | (2006.01) |
| ***B65D 77/06*** | (2006.01) |
| ***B65D 85/68*** | (2006.01) |
| ***B65D 88/60*** | (2006.01) |
| ***B65D 90/04*** | (2006.01) |

(56) References Cited

U.S. PATENT DOCUMENTS

| | | | | |
|---|---|---|---|---|
| 3,040,897 | A * | 6/1962 | Holman | 210/244 |
| 3,248,156 | A * | 4/1966 | Repko | 312/71 |
| 3,314,210 | A * | 4/1967 | Jarund | 53/449 |
| 3,416,692 | A * | 12/1968 | Cline et al. | 220/592.25 |
| 3,565,292 | A * | 2/1971 | Jinotti et al. | 222/103 |
| 3,727,793 | A * | 4/1973 | Staubly | 220/578 |
| 3,752,354 | A | 8/1973 | Demirag | |
| 3,904,083 | A * | 9/1975 | Little | 222/82 |
| 3,987,941 | A * | 10/1976 | Blessing | 222/386 |
| 4,660,353 | A * | 4/1987 | Greenwell | 53/449 |
| 4,918,906 | A * | 4/1990 | Ako | 53/449 |
| 5,275,290 | A * | 1/1994 | Bierfreund | 206/522 |
| 5,314,088 | A * | 5/1994 | Heuberger et al. | 229/117.3 |
| 5,361,940 | A * | 11/1994 | Miller et al. | 222/77 |
| 5,553,740 | A * | 9/1996 | King et al. | 222/1 |
| 5,906,568 | A * | 5/1999 | Sato et al. | 493/87 |
| 5,979,650 | A * | 11/1999 | Dull | 206/447 |
| 5,988,422 | A | 11/1999 | Vallot | |
| 6,076,457 | A | 6/2000 | Vallot | |
| 6,131,766 | A * | 10/2000 | King et al. | 222/1 |
| 6,158,628 | A * | 12/2000 | Englram et al. | 222/389 |
| 6,286,700 | B1 * | 9/2001 | Davidson | 220/1.6 |
| 6,348,043 | B1 * | 2/2002 | Hagen et al. | 604/151 |
| 6,374,579 | B1 * | 4/2002 | Muller | 53/449 |
| 2006/0249535 | A1 | 11/2006 | Mauger et al. | |
| 2007/0045339 | A1 * | 3/2007 | Manion | 222/95 |
| 2008/0017649 | A1 * | 1/2008 | Elgan et al. | 220/495.06 |
| 2008/0257447 | A1 * | 10/2008 | Mauger et al. | 141/2 |
| 2009/0166281 | A1 * | 7/2009 | Antonetti | 210/242.1 |
| 2010/0006594 | A1 | 1/2010 | Mauger et al. | |
| 2012/0111894 | A1 * | 5/2012 | Bakhos | 222/209 |

FOREIGN PATENT DOCUMENTS

| | | | |
|---|---|---|---|
| EP | 1 012 073 | B1 | 3/2002 |
| FR | 0 932 321 | A | 3/1948 |
| GB | 2 159 583 | A | 12/1985 |
| GB | 2 234 556 | A | 2/1991 |
| WO | 00/04131 | A1 | 1/2000 |
| WO | 2004/074164 | A1 | 9/2004 |
| WO | 2006/070010 | A1 | 7/2006 |

OTHER PUBLICATIONS

International Search Report, dated Oct. 25, 2010, from corresponding PCT application.

* cited by examiner

RIGID CONTAINER FOR A FLEXIBLE POUCH FOR HOLDING A BIOPHARMACEUTICAL FLUID, ASSEMBLY COMPRISING SUCH A FLEXIBLE POUCH AND SUCH A CONTAINER, AND METHOD FOR USING SUCH A CONTAINER

BACKGROUND OF THE INVENTION

1. Field of the Invention

The invention relates to the field of packaging biopharmaceutical fluids, and it relates more specially to a rigid container for a flexible 3D (three-dimensional) pouch, designed to contain such a biopharmaceutical fluid, a flexible 3D pouch that is designed for such a container, and a process for implementation of such a container.

2. Description of the Related Art

"Biopharmaceutical product" is defined as a product that is obtained from biotechnology—culture media, cellular cultures, buffer solutions, artificial nutrition liquids, blood products, and derivatives of blood products—or a pharmaceutical product or more generally a product that is designed to be used in the medical field. Such a product is in liquid, pasty or optionally powder form. The invention also applies to products that are different but that are subject to analogous requirements as regards their packaging.

A 3D pouch is known that is designed to accommodate such a biopharmaceutical product, which comprises a lower end wall, an upper end wall, and a flexible side wall that can be in two end states—folded flat and deployed unfolded—and can be deformed to switch from one to the other of these states or to be in any intermediate state. The walls of the pouch, made of a plastic material such as polyethylene or a complex that comprises polyethylene, delimit an inner space that, in the folded state, has a minimum volume, and, in the unfolded and deployed state, has a maximum volume. This space is designed to accommodate the biopharmaceutical product for storage, treatment, and monitoring. Such a disposable, biocompatible, flexible pouch can have a large volume of at least 50 liters up to 3,000 liters and even more, which justifies the fact that it is described as 3D. Such a pouch thus offers a large capacity while being able to be easily stored. An example of such a pouch is described in the International Application WO00/04131.

Such a flexible 3D pouch, when it is filled with biopharmaceutical product, is to be placed in a rigid container that holds it by the outside. This requirement is most particularly important in the case where the pouch that is filled with biopharmaceutical product is to be shipped and transported by road, train, or by air. Actually, there is then the risk that the integrity of the pouch is affected as a result of impacts, forces, deformations . . . which can in turn affect the biopharmaceutical product that it contains.

In one embodiment, such a rigid container comprises a lower transverse wall and an erect side peripheral axial wall that limits an upper transverse opening with access to a housing that is defined by the inner surfaces of these walls and is able to accommodate the pouch that contains the biopharmaceutical fluid that was just applied against these inner surfaces.

The document EP-A-1012073 describes such a container, also equipped with a wall for protection and containment that can be placed transversely in the housing of the rigid container, having dimensions such that the transverse gap between its outside peripheral free edge and the inner surface of the side wall opposite the rigid container is limited. Such a wall for protection and containment is able to be applied with a certain axial force against the outside surface of the upper end wall of the pouch and to be held fixed in this position by holding means in the active state, resting via a screw cylinder system on removable spars located in this case in the upper part of the rigid container.

With the arrangement according to the document EP-A-1012073, the axial space requirement in height of the cylinder system determines the travel in height at which the plate for protection and containment can be located. Either this space requirement is selected to be limited, for the advantages that this provides, with the drawback that the plate for protection and containment can be used only with a completely filled pouch, or, if it is desired that the travel of the containment plate be as great as possible, for example because the pouch could be only partially filled, the cylinder system necessarily has a large axial space requirement in height, which is a source of problems, the lack of compactness being a serious handicap for shipping and transport.

Actually, since the flexible pouch has a large maximum capacity and in view of the very nature of its contents—a biopharmaceutical product—it should be possible to use the pouch continuously without having to fill it completely, and with variable volumes. However, this situation poses another problem when the flexible pouch that is partially filled with biopharmaceutical product is to be shipped and transported, primarily over a significant distance and under conditions such that it is prone to abrupt movements or to significant accelerations, because the high inertia of the contents of the flexible pouch then creates a movement of imbalance of the pouch and its contents that can affect the integrity of the pouch and therefore of its contents.

The document WO 2006/070010 describes a process for packaging a viscous product that is contained in a flexible pouch with a capacity that is greater than 50 liters, preferably greater than 100 liters, in volume units with a capacity of less than 50 liters, preferably less than 100 liters. This flexible pouch comprises a passage for evacuation of the viscous product located on its upper end wall. This flexible pouch, filled with viscous product, is placed in a rigid container that has a lower transverse wall that forms a pressure piston, mounted to slide vertically and driven by a cylinder system placed below this lower transverse wall and above a stationary lower floor. This container further comprises a stationary upper cover that is reversible and is equipped with an opening for sending the viscous product to a packaging machine in a smaller volume, in communication with the passage for evacuation of the flexible pouch. By deploying the cylinder, the lower transverse wall is moved upward, and the flexible pouch is compressed between this wall and the cover, which makes it possible to expel the viscous product from the flexible pouch for sending it to the packaging machine.

The goal of the arrangement according to the document WO 2006/070010 is to produce viscous products, but not biopharmaceutical products. It does not have the objective of preserving the integrity of the pouch and its contents, and its goal is not the case of a pouch that is partially filled with its contents being able to be shipped and transported over a significant distance and/or under conditions that are suitable for generating abrupt movements or significant accelerations. This arrangement is not concerned, moreover, with the compactness of the rigid container. Finally, this arrangement imposes an evacuation at the top, whereas in the case of 3D pouches for biopharmaceutical products, the evacuation is most often at the bottom. In the arrangement according to the document WO 2004/074164, this drawback is eliminated, but not the others, in particular the lack of compactness. Analogous devices are described in the documents GB-A-2159583 and BE-A-539623.

Also known from the document FR-A-0 932 321 is a container that comprises, on the one hand, a tank inside of which an envelope is placed, and, on the other hand, a holding plate that rests on the envelope when the latter is not completely filled or its size in height is less than that of the tank. The holding plate is then held inside the tank by means of a pressure screw working with threaded recesses arranged in the inside wall of the tank, as shown in FIG. 4 of this document.

One drawback of this device is that it does not make it possible to preserve the integrity of the envelope regardless of its filling volume. Actually, the position of the holding plate necessarily depends on the position of the threaded recesses. Consequently, the position of this holding plate with respect to the bottom of the tank cannot be modulated continuously because of the filling of the envelope.

Also known from the state of the art is the document EP-A-0 456 403 that discloses a container for a flexible pouch that is filled with a pharmaceutical product. According to this embodiment, a support element is attached to the upper surface of the flexible pouch so as to move this upper surface to the same level as the product when a portion of this product flows from the flexible pouch.

Such an embodiment has, like the preceding embodiments, several drawbacks. In particular, the use of a support element is inadequate for preventing the pharmaceutical product that is contained in the flexible pouch from sloshing inside the latter when the container is put into motion. Actually, the weight alone of the support element does not provide an adequate holding force to counter the forces exerted on the flexible pouch when the product that it contains is put into motion and moves about.

There is therefore a need for a rigid container for a large-capacity flexible 3D pouch that, on the one hand, is able to preserve the integrity of the pouch and its contents, even when the pouch is only partially filled with biopharmaceutical product, when the thus filled pouch is shipped and transported over a significant distance and/or under conditions suitable for generating abrupt movements or significant accelerations, and that, on the other hand, is compact.

SUMMARY OF THE INVENTION

For this purpose, and according to a first aspect, the invention proposes a rigid container for a flexible pouch that is specially designed to contain a biopharmaceutical fluid, comprising:

A lower transverse wall and an erect side peripheral axial wall that limits an upper transverse opening with access to a housing that is defined by the inner surfaces of the lower and side walls and is able to accommodate the flexible pouch that contains the biopharmaceutical fluid that was just applied against these inner surfaces, Containment means that comprise a containment wall, With the containment wall being able to be placed transversely in the housing and having dimensions such that the transverse gap between its outside peripheral free edge and the inner surface of the side wall opposite it is limited, With the containment wall being able to be applied with a certain axial force against the free upper surface of the upper transverse wall of the pouch and to be held fixed in this position by holding means in the active state, Holding means that, in the active state, are applied on the inner surface of the side wall so as to hold fixed in position the containment wall that is applied with said certain force against the free upper surface of the pouch, characterized in that the holding means, arranged transversely in the container and borne by the containment means of which they are part, by a structural and functional combination are movable or deformable in the transverse direction between an inactive retracted state and an active expanded state in which, respectively, a distal end part of these holding means is either separated from the inner surface of the side wall opposite it or is applied against it without any chance of inadvertent sliding, in such a way that, in the active state of the holding means and their distal end part, the containment wall is held fixed in position with respect to the walls of the container, and in that these holding means are able to be applied at any desired location of a continuous zone of the inner surface of the side wall, extended in axial direction, in such a way that the containment wall can be placed in the housing at the desired distance from the lower transverse wall or from the upper transverse opening, to be able to be applied and held with a certain axial force against the free transverse upper surface of the pouch regardless of how full the latter is.

According to a first embodiment, the containment wall is inherently rigid enough and able, in itself, to absorb said certain force without substantial deformation.

According to a second embodiment, the containment wall is not inherently rigid enough and able, in itself, to absorb said certain force without substantial deformation, with the containment means comprising stiffening means that are able, being active, to act on the containment wall to stiffen it enough so that, thus stiffened, it is able to absorb said certain force without substantial deformation.

In this second embodiment, and according to one possibility, the containment wall is stiffened by stiffening means in the form of at least one stiffening chamber placed above or below (according to two different variants) the containment wall or in an opening of the stiffening wall in the form of a frame (according to a third possible variant), which deformable and essentially inelastic stiffening chamber is rigid and active by being filled with a fluid. In particular, the stiffening means comprise at least one stiffening chamber that is equipped with an inlet/outlet port for filling fluid and means for filling and draining the at least one chamber that are able to be combined with the inlet/outlet port.

In this second embodiment and according to a first variant, the containment wall is separate but applied against the lower or upper surface of at least one stiffening chamber. According to a second variant, the containment wall is part of the lower wall of the at least one stiffening chamber.

In this second embodiment, and according to one variant, the holding means are borne by stiffening means.

According to another first embodiment, the containment means are inherently heavy enough and able, in themselves, to exert by their own weight said certain force against the free upper surface of the pouch.

According to another second embodiment, the containment means are not inherently rigid enough and able, in themselves, to exert by their own weight said certain force against the free upper surface of the pouch, with the containment means comprising means for application of a force that can, being active, act on the containment wall to exert on it a force such that the containment means in turn exert said certain force against the free upper surface of the pouch.

In this other second embodiment, and according to a variant, said means for application of a force are manual or human means, a cylinder, or heavy weights.

According to another possible embodiment, the holding means are borne by the containment wall.

According to another possible embodiment, the containment means comprise, below, the containment wall, and, above, a support element that is extended transversely, placed perpendicular to the containment wall, whereby the holding means are borne by said support element, with the means for rigid connection and transmission of forces being interposed between and combined with the containment wall and the support element, and being able to provide a rigid connection for transmission of said certain force between the containment wall and the support element.

In this latter embodiment and according to a first variant, the means for rigid connection and transmission of forces are essentially non-deformable.

According to a second variant, the means for rigid connection and transmission of forces are deformable between two end states, a retracted state and an expanded state, in which, respectively, the containment wall is brought closer to and moved farther from means for holding that are borne by said support element; maneuvering means being provided and able to switch the means for rigid connection and transmission of forces are deformable between their two end states, whereby these maneuvering means constitute means for relative movement of the containment wall with respect to the support element.

In this second variant, and according to one embodiment, in the expanded state of the means for rigid connection and transmission of forces, the containment wall is located close to the lower transverse wall.

According to one embodiment, the support element is selected from the group that comprises either a rigid plate, a rigid frame, a deformable and essentially inelastic chamber made rigid by being filled with a fluid, equipped with an inlet/outlet port for filling fluid, means for filling and draining that are able to be combined with the inlet/outlet port, or a combination of the latter.

According to one variant according to this embodiment, a support element in plate form is able to be placed transversely in the housing, having dimensions such that the transverse gap between its outside peripheral free edge and the inner surface of the side wall opposite it is limited.

According to one embodiment, the means for relative movement that comprise the means for rigid connection and transmission of forces and the maneuvering means are selected from the group that comprises either a cylinder, a deformable chamber made more or less flat or more or less expanded by a more or less significant filling with a fluid, equipped with an inlet/outlet port for a filling fluid, with means for filling and draining being able to be combined with the inlet/outlet port, or a combination of the latter, placed between the containment wall and the support element.

According to one embodiment, the containment wall is structurally separate from the flexible pouch that is designed to contain a biopharmaceutical fluid.

According to one embodiment, the containment wall is a structural part of the flexible pouch that is designed to contain a biopharmaceutical fluid.

According to one embodiment, the container also comprises a removable cover.

According to one embodiment, the container also comprises one or more doors or one or more openings that are made in the lower transverse wall and/or the erect side peripheral axial wall, able to correspond to ports, openings, or pipes of the flexible pouch, or ports, openings, or pipes that are combined with the flexible pouch.

According to one embodiment, the lower surface of the containment wall lacks rough spots that are likely to damage the pouch.

According to one embodiment, an elastically deformable element that is designed to assume the shape of the free upper surface of the pouch is combined with the containment wall.

According to one embodiment, the containment wall comprises one or more holes, cutouts or pipe passages, connections or pipes or the like that are functionally combined with or designed to be functionally combined with the pouch.

According to a second aspect, the invention proposes an assembly of a container and a flexible pouch that is specially designed to contain a biopharmaceutical fluid, with which there is structurally combined, in an upper part, at least a portion of the holding means, with the pouch thus being specially designed to form part of a container according to one of the embodiments described above.

According to one embodiment, a containment wall that is part of the containment means is structurally combined with the flexible pouch, in the upper part.

According to another embodiment, an inherently rigid containment wall is combined with the pouch itself.

According to another embodiment, a containment wall that is not inherently rigid, which forms part of the lower wall of at least one stiffening chamber placed above the containment wall—which deformable and substantially inelastic stiffening chamber is made rigid and active by being filled with a fluid—is combined with the pouch itself.

According to one embodiment, the pouch also comprises holding means borne by the containment wall.

According to a third aspect, and a first embodiment, the invention proposes a process for implementing a container as described above, in which:

An empty flexible pouch is provided;

The empty flexible pouch is placed in the housing of the container in such a way that it can be deployed in the latter;

The pouch is filled through an opening to introduce therein a certain quantity of biopharmaceutical fluid, with the pouch thus being at least partially deployed, its side wall being held by the side wall of the container, and then the opening of the thus filled pouch is closed;

At any time and regardless of how full the pouch is, the containment means, whose holding means are in the inactive retracted state, are brought transversely into the housing of the container until the containment wall comes against the free transverse upper surface of the pouch and is applied on it with a certain axial force;

In this situation, the holding means are switched from the inactive refracted state to the active expanded state, and thus the distal end part is locked on the inner surface of the side wall opposite it, without any chance of inadvertent sliding, at any corresponding location of the continuous zone.

According to a second embodiment, the invention proposes a process for implementing a container as described above, in which:

An empty flexible pouch is provided;

The empty flexible pouch is placed in the housing of the container in such a way that it can be deployed in the latter;

The containment means, whose holding means are in the inactive refracted state, are brought transversely into the housing of the container until the containment wall comes against the free transverse upper surface of the pouch;

The pouch is filled through an opening to introduce therein a certain quantity of biopharmaceutical fluid, with the pouch thus being at least partially deployed, its side wall being contained by the side wall of the container, and then the opening of the thus filled pouch is closed;

In this situation, the holding means are switched from the inactive refracted state to the active expanded state, and thus the distal end part is locked on the inner surface of the side wall opposite it, without any chance of inadvertent sliding, at any corresponding location of the continuous zone.

According to one embodiment in the case where means for relative movement of the containment wall with respect to the support element are provided, when the containment means are brought into the housing of the container and when the holding means are switched from the inactive retracted state to the active expanded state, the means for relative movement of the containment wall with respect to the flat element are in the retracted state.

According to one embodiment, in the case where means for relative movement of the containment wall with respect to the support element are provided, when it is desired to drain the pouch, the means for relative movement of the containment wall with respect to the support element are switched from the retracted state to the expanded state.

According to one embodiment, a flexible pouch is selected with which at least one portion of the containment means is combined structurally, in the upper part.

According to one embodiment, once the holding means are switched from the inactive retracted state to the active expanded state, and thus the distal end part of the inner surface of the side wall opposite it is locked, without any chance of inadvertent sliding, at any corresponding location of the continuous zone, the container that holds the pouch filled with its contents is shipped and transported. As indicated above, this shipping and this transport are done without the integrity of the pouch being altered.

BRIEF DESCRIPTION OF THE DRAWING FIGURES

Several embodiments of the invention are now described using drawings, in which.

Figure 4:
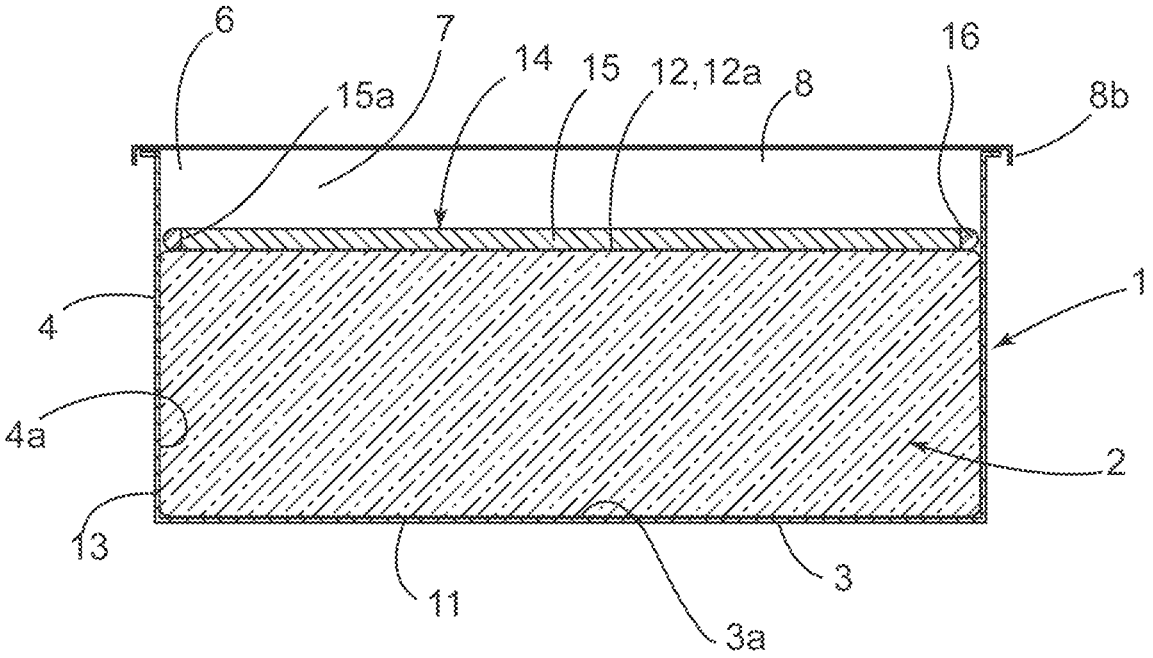
FIG. 4 is a simplified cutaway diagram through a vertical plane of the rigid container, in the case of a containment plate that is inherently rigid enough.
Figure 6A:
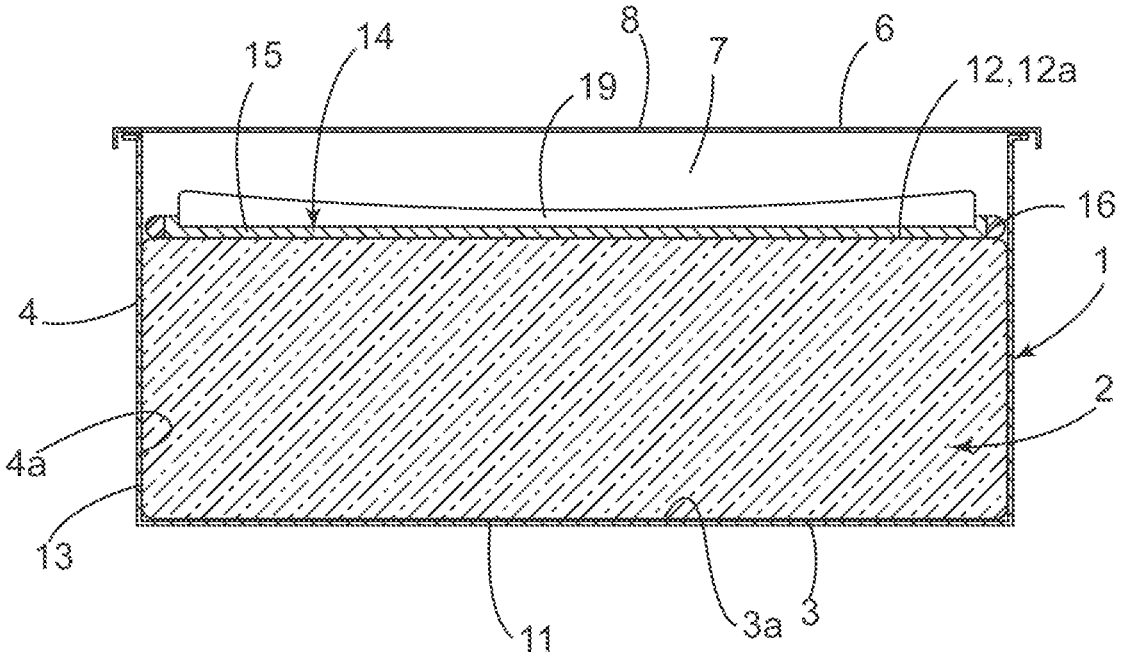
Figure 6B:
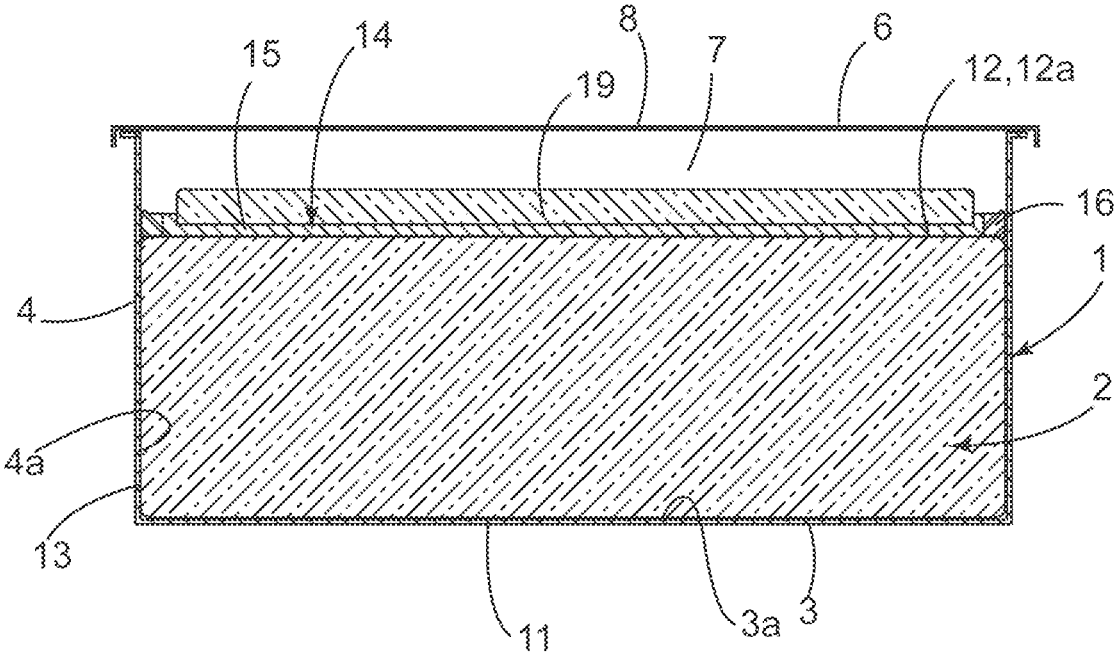

FIGS. 6A and 6B are two diagrams that are analogous to the diagram of FIG. 4 of a possible variant embodiment in the case of a containment plate with which are combined stiffening means, in this case a stiffening chamber placed above the containment plate, whereby the latter is not inherently rigid enough and able to absorb the force exerted on the 3D pouch without substantial deformation. In FIG. 6A, these stiffening means are inactive, while in FIG. 6B, they are active.

Figure 7A:
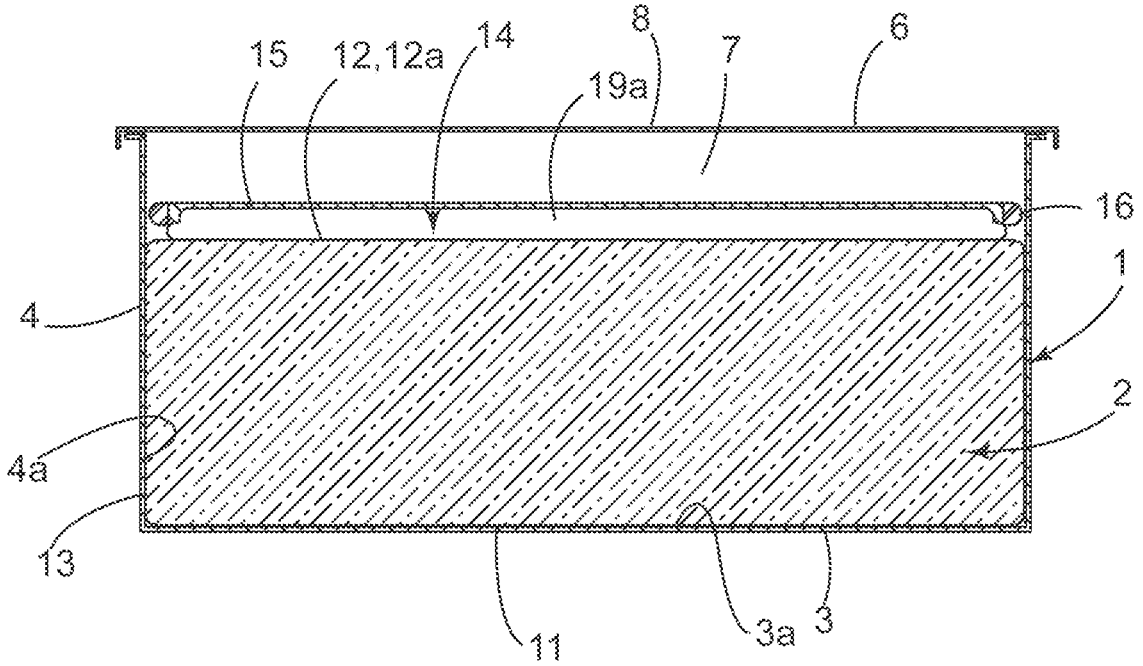
Figure 7B:
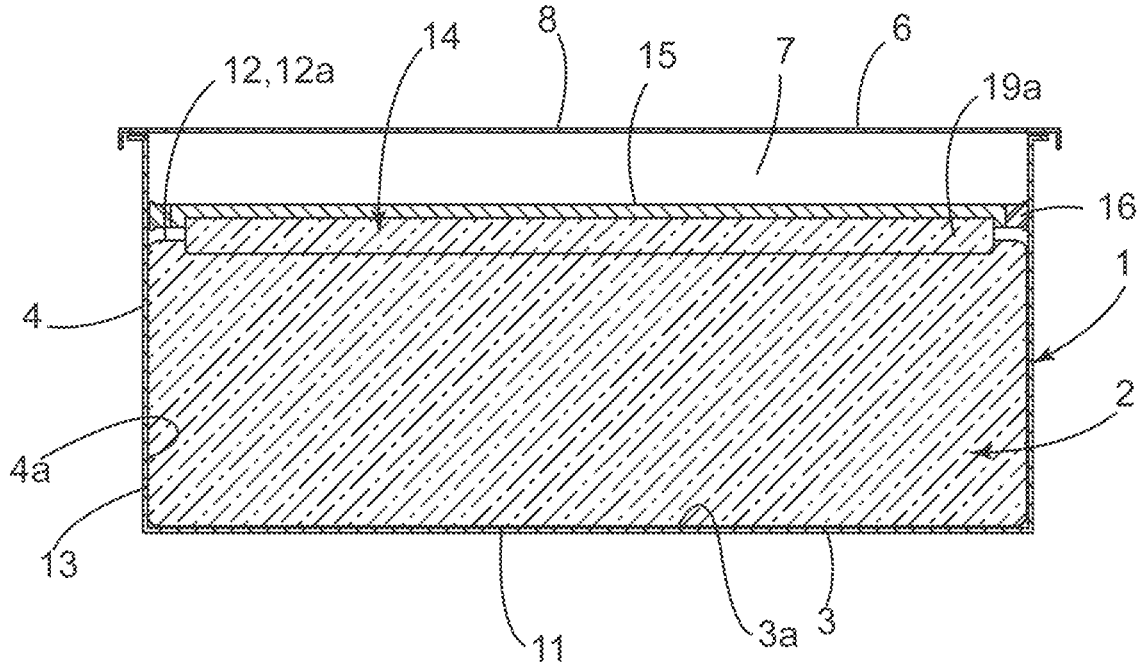

FIGS. 7A and 7B are two diagrams that are analogous to the diagrams of FIGS. 6A and 6B, in another possible variant embodiment, with the stiffening chamber being placed here below the containment plate.

Figure 8A:
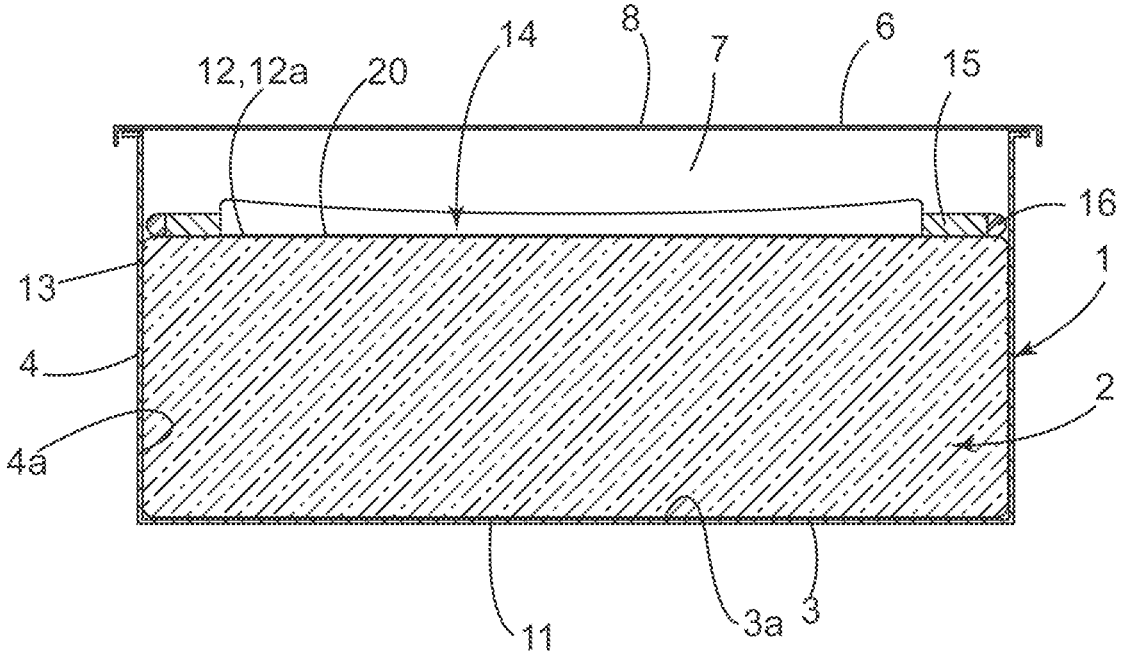
Figure 8B:
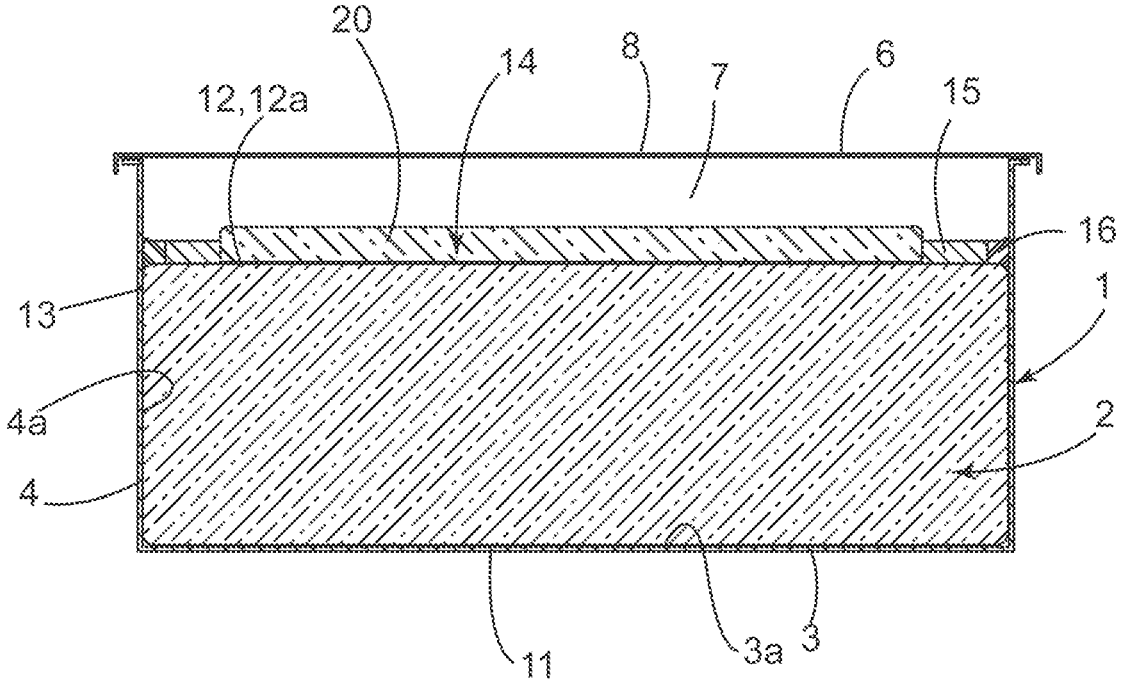

FIGS. 8A and 8B are two diagrams that are analogous to the diagrams of FIGS. 6A, 7A and 6B, 7B in another possible variant embodiment where the containment wall is in the shape of a frame, while the stiffening chamber is placed within the frame.

Figure 9A:
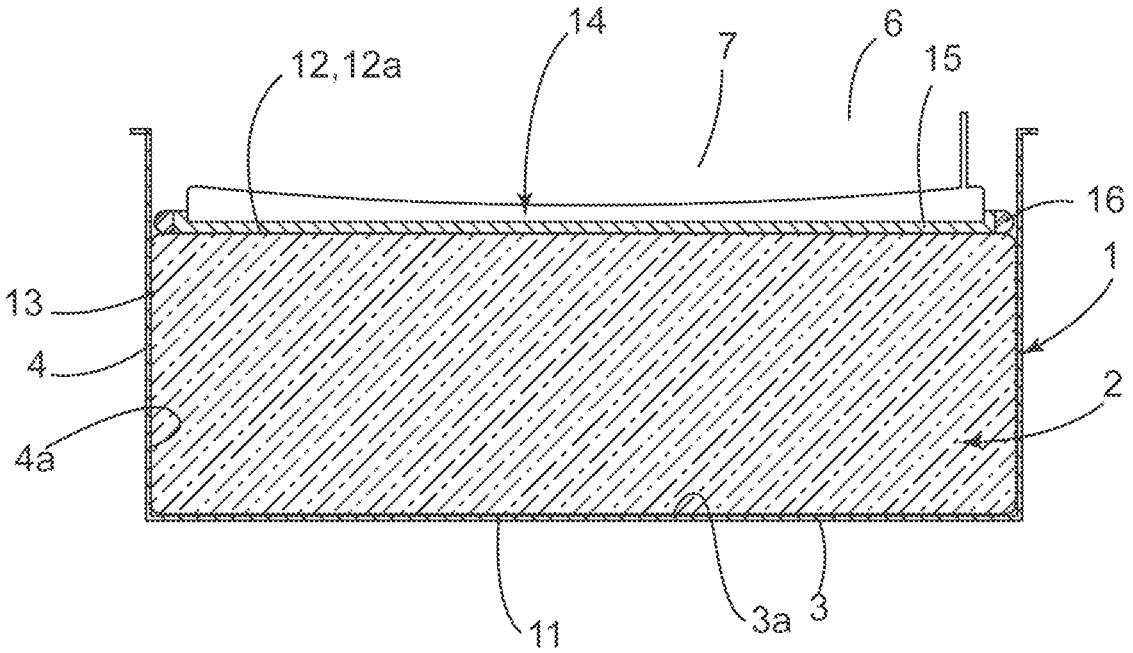
Figure 9B:
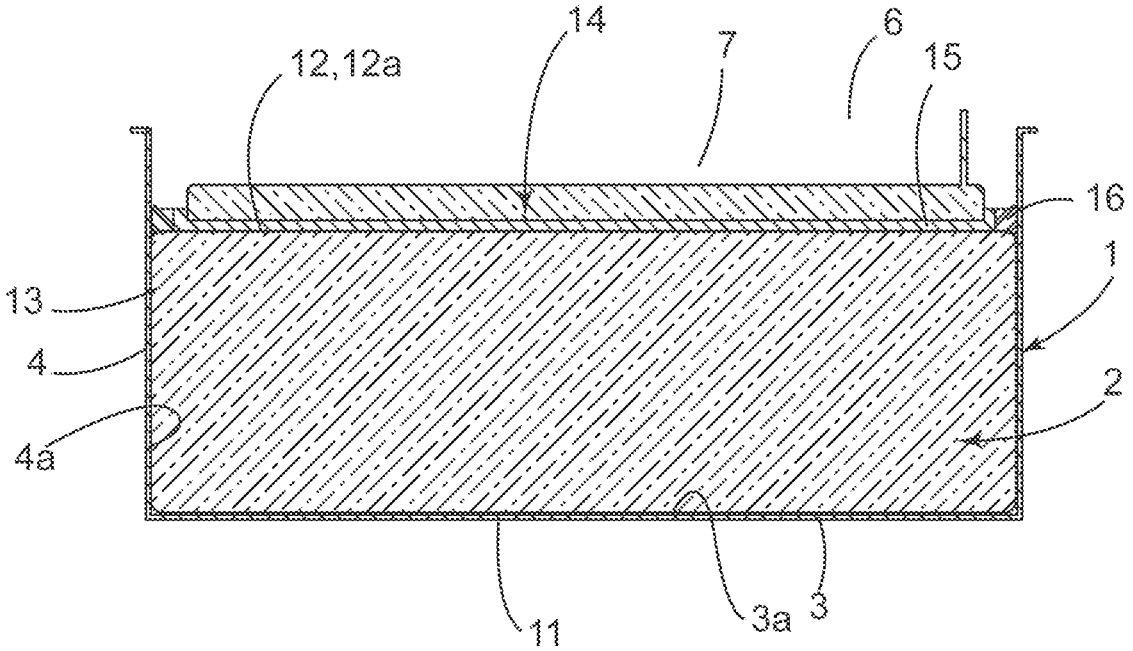

FIGS. 9A and 9B are two diagrams that are analogous to the diagrams of FIGS. 6A, 7A, and 8A, and 6B, 7B, and 8B, illustrating an inlet/outlet fluid port of the stiffening chamber.

Figure 10A:
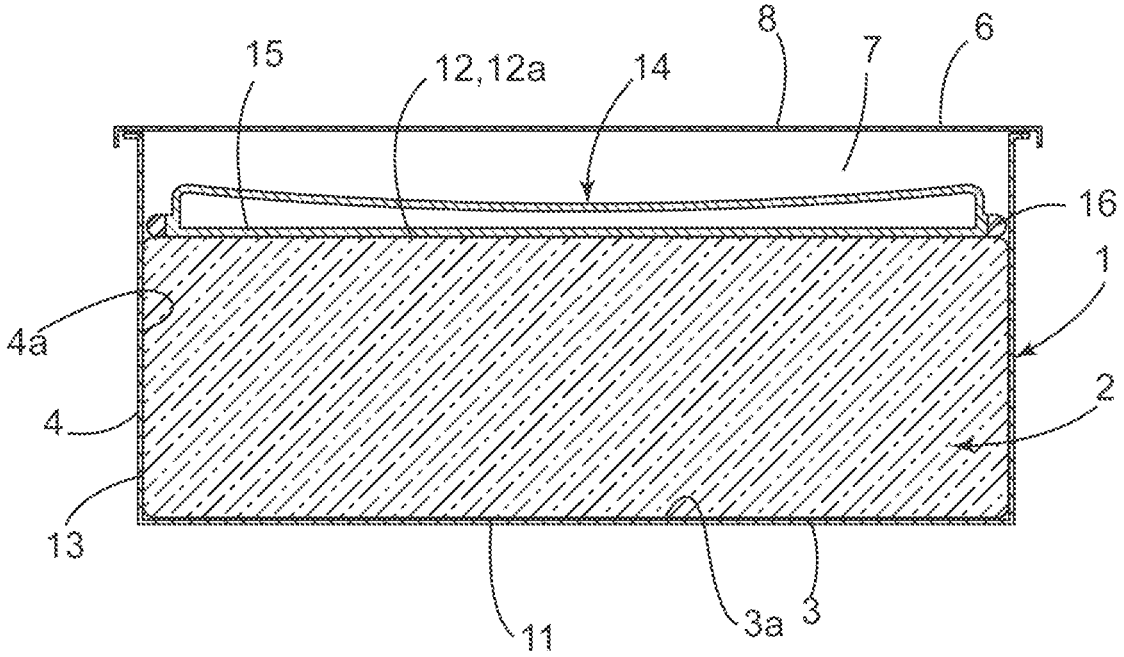
Figure 10B:
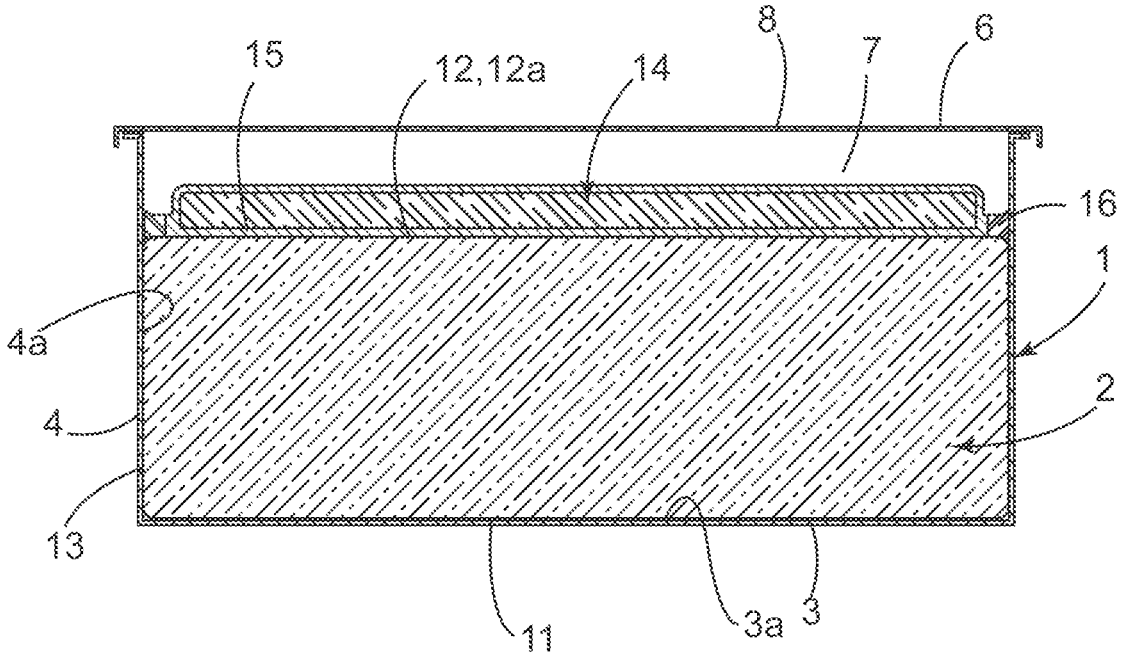
Figure 11A:
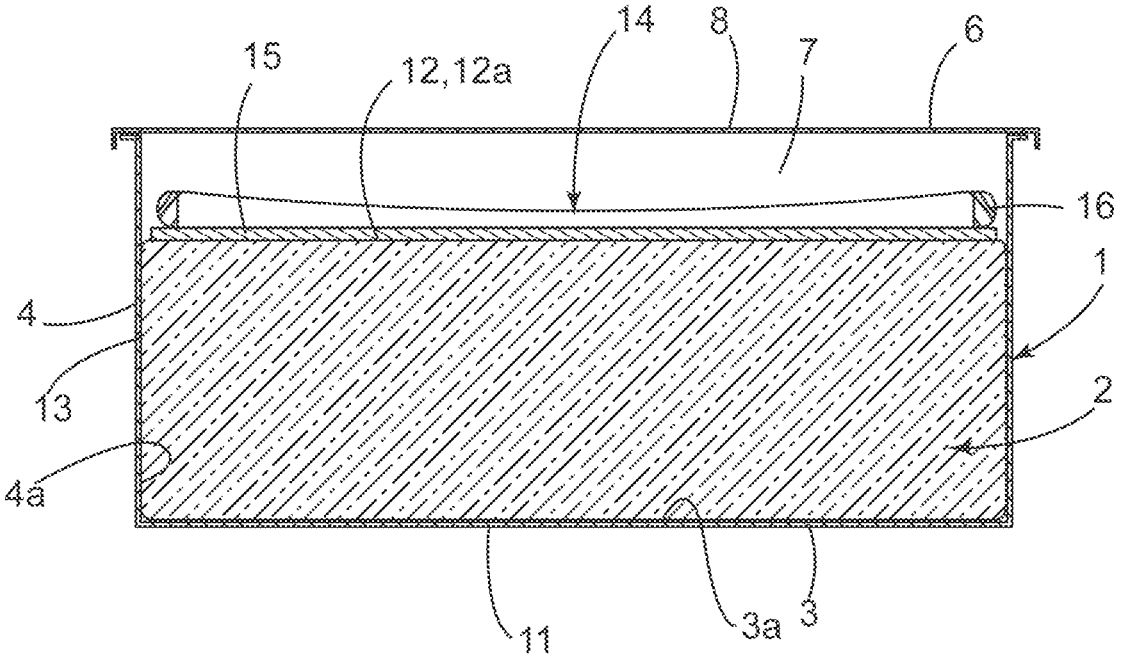
Figure 11B:
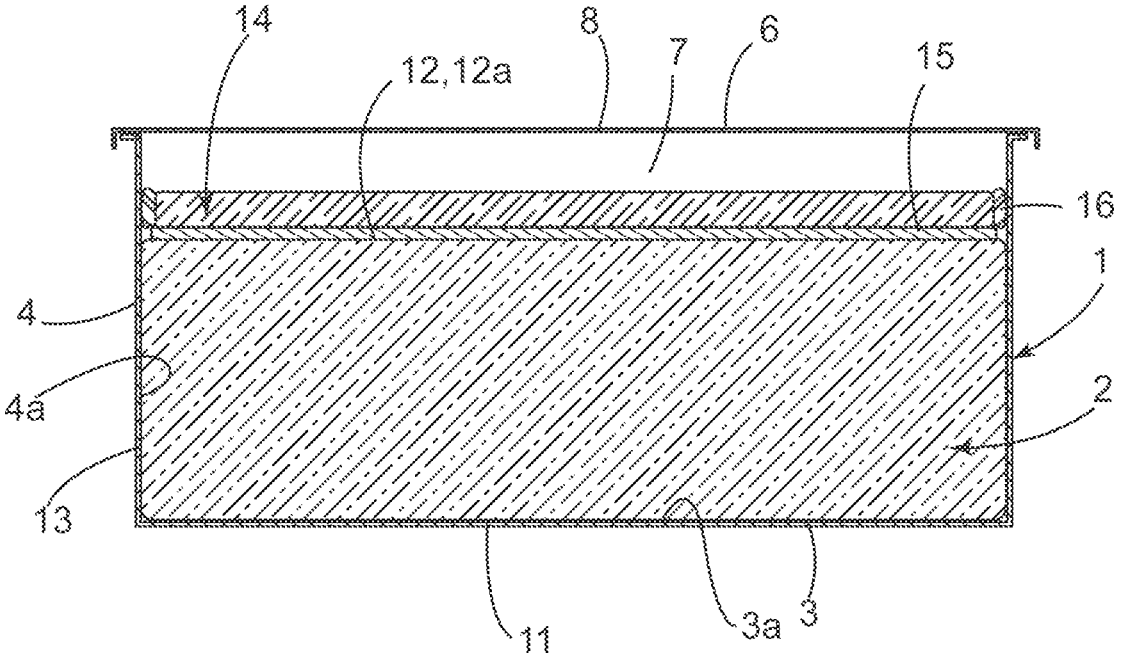
Figure 12A:
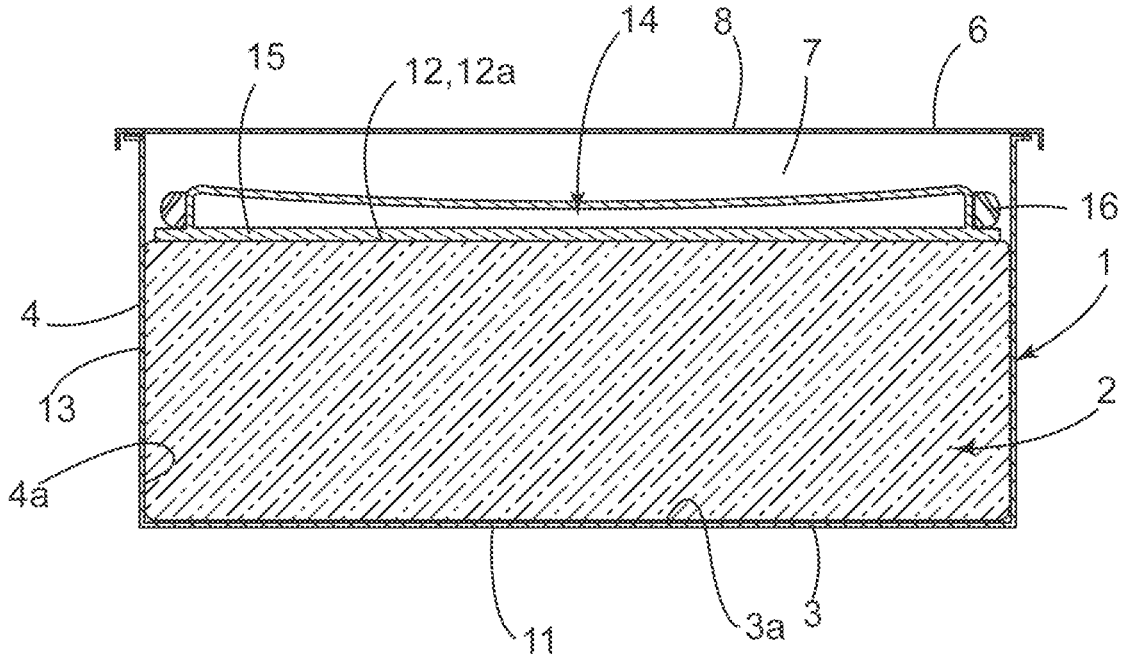
Figure 12B:
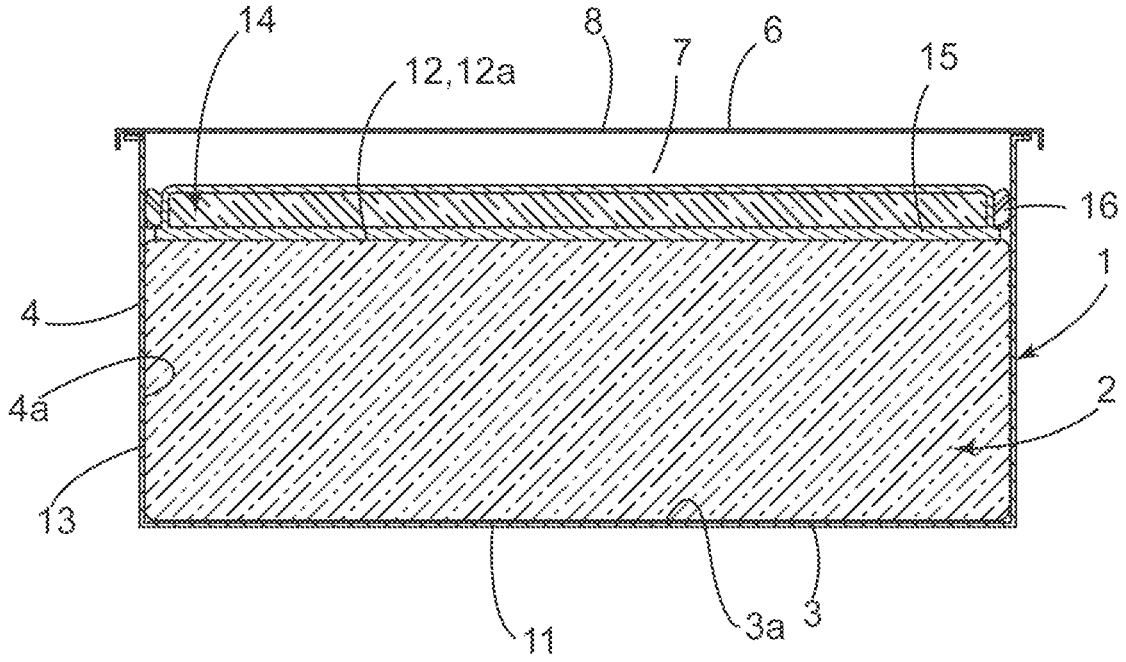

FIGS. 10A and 10B are two diagrams that are analogous to the preceding diagrams, in a variant in which the containment wall is part of the lower wall of the stiffening chamber.

FIGS. 11A and 11B and 12A and 12B are four diagrams that are analogous to the preceding diagrams, in two variants in which the holding means are borne by the stiffening means.

FIGS. 13A, 13B, 14A, 14B, 15A, 15B, 16A, and 16B are diagrams, analogous to the preceding diagrams, of several variant embodiments that relate to rigid connecting means and means for transmission of forces interposed between the containment wall and a support element.

FIGS. 17A, 17B, 18A, and 18B are diagrams, analogous to the preceding diagrams, of several variant embodiments relative to the means for relative movement formed by the deformable, rigid connecting means.

Figure 19:
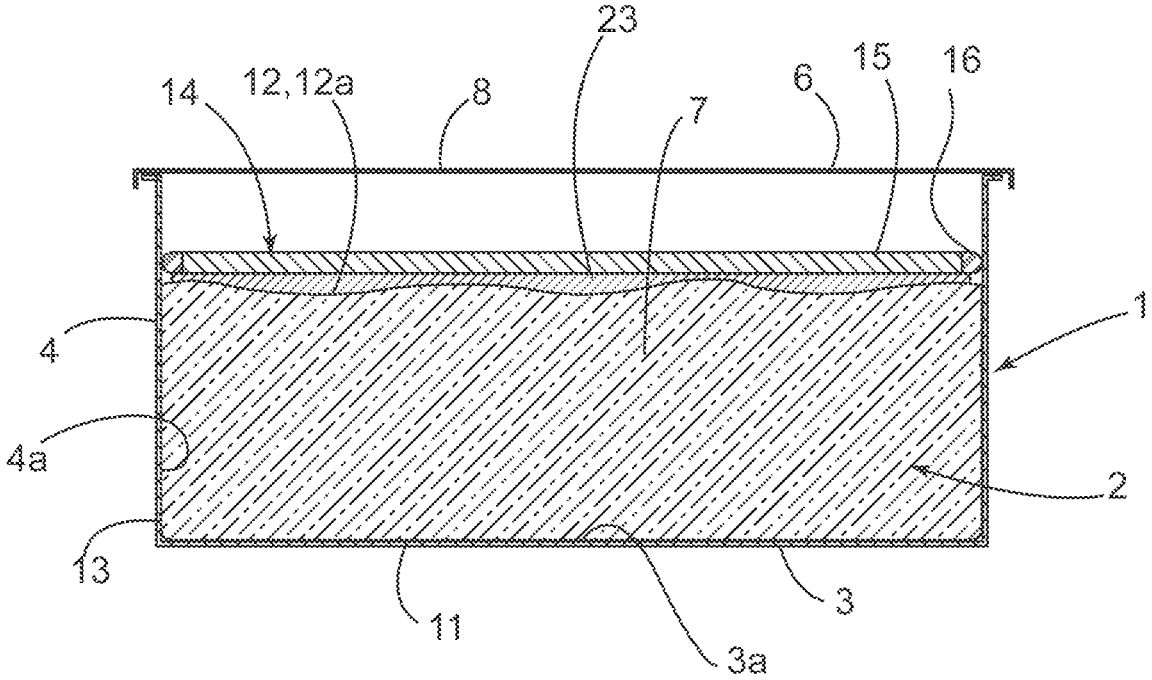

FIG. 19 is a diagram that is analogous to the preceding diagrams illustrating an embodiment where the containment plate incorporates a deformable elastic element.

Figure 20:
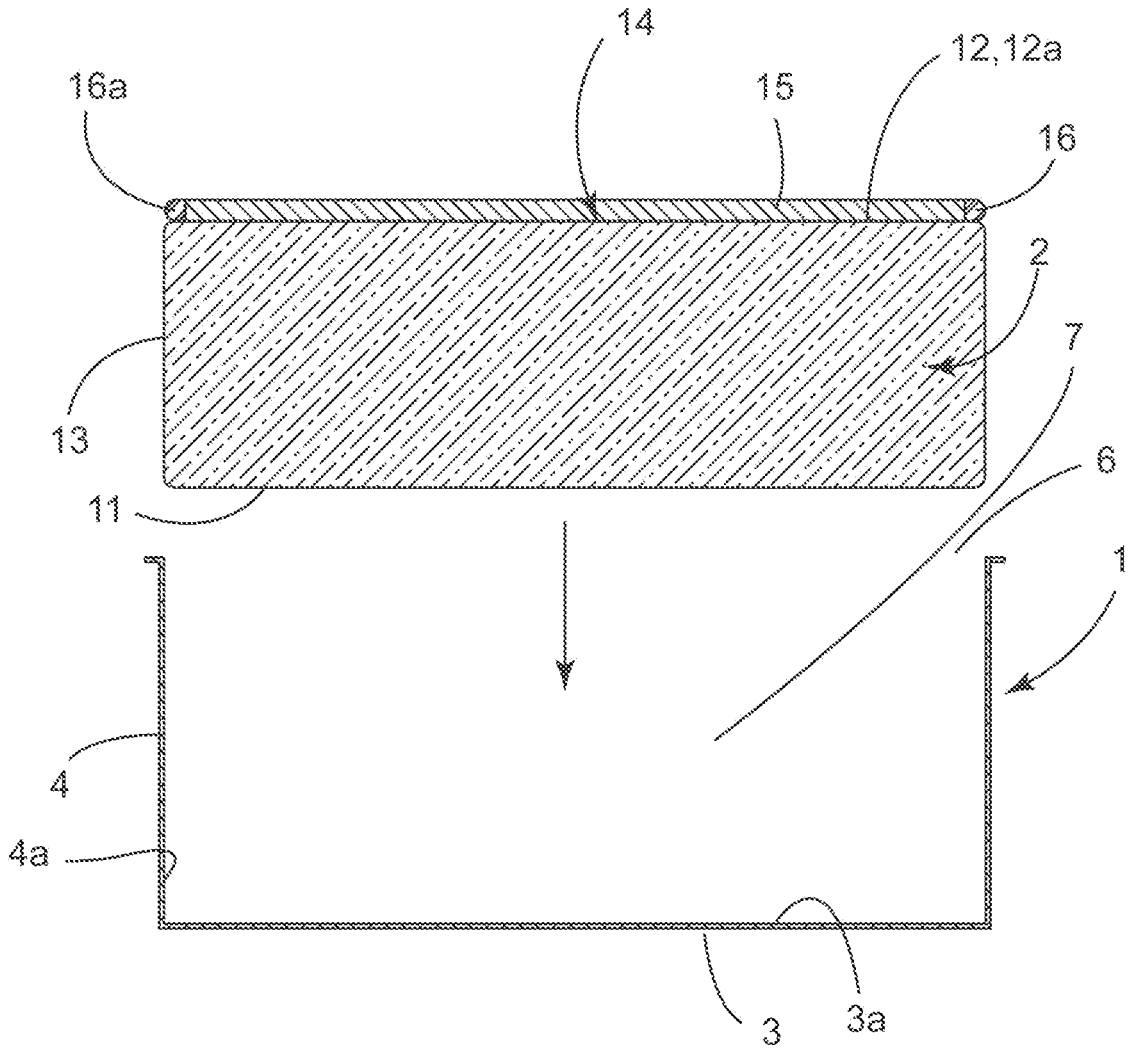

FIG. 20 is a diagram that is analogous to the preceding diagrams, but separated, illustrating an implementation of the flexible 3D pouch in which the latter incorporates an inherently rigid containment wall.

FIGS. 21A, 21B, 22A and 22B are diagrams that are analogous to the preceding diagrams in which the flexible 3D pouch incorporates parts of containment means.

Figure 23A:
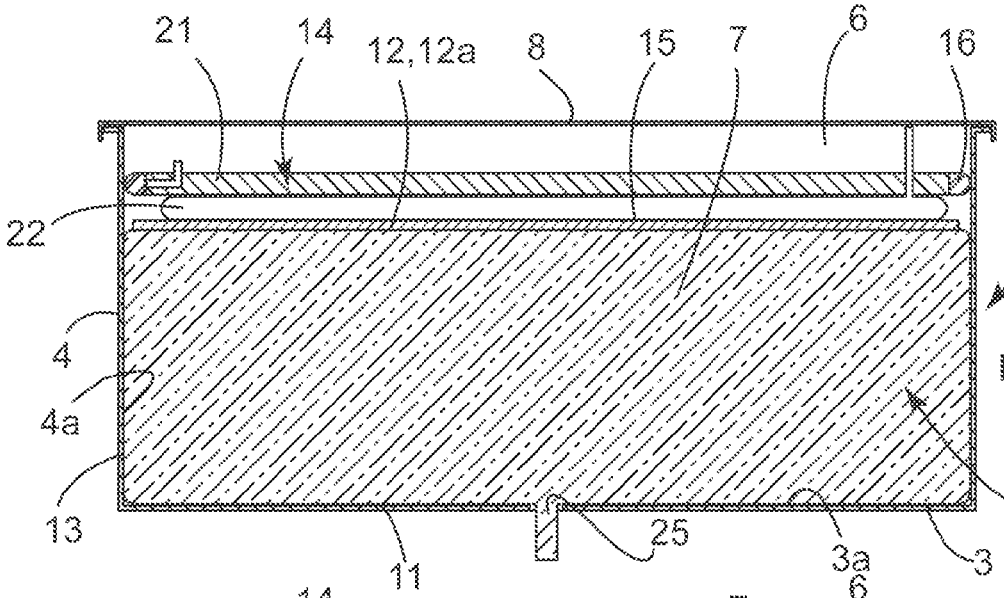
Figure 23B:
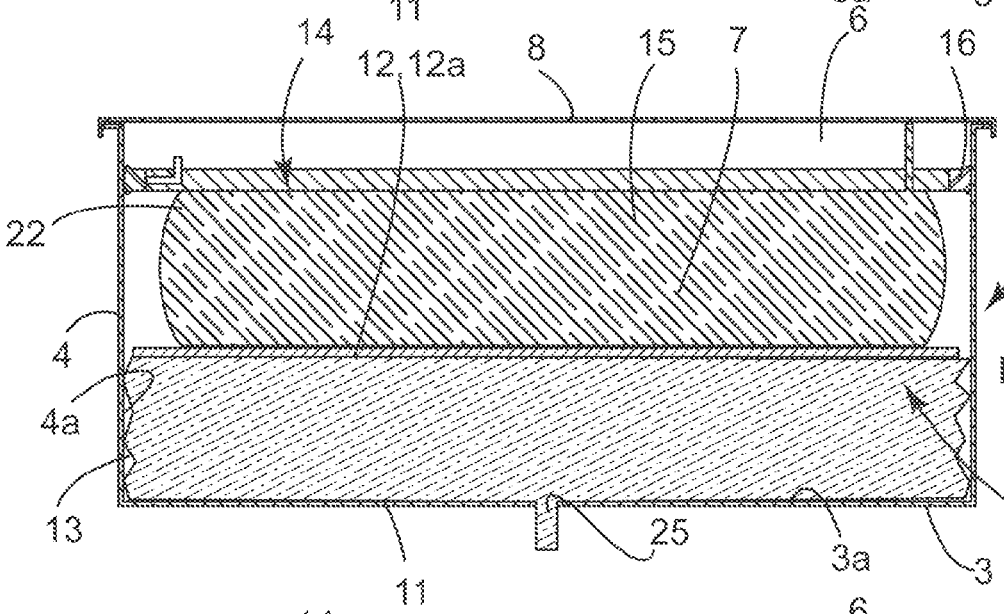
Figure 23C:
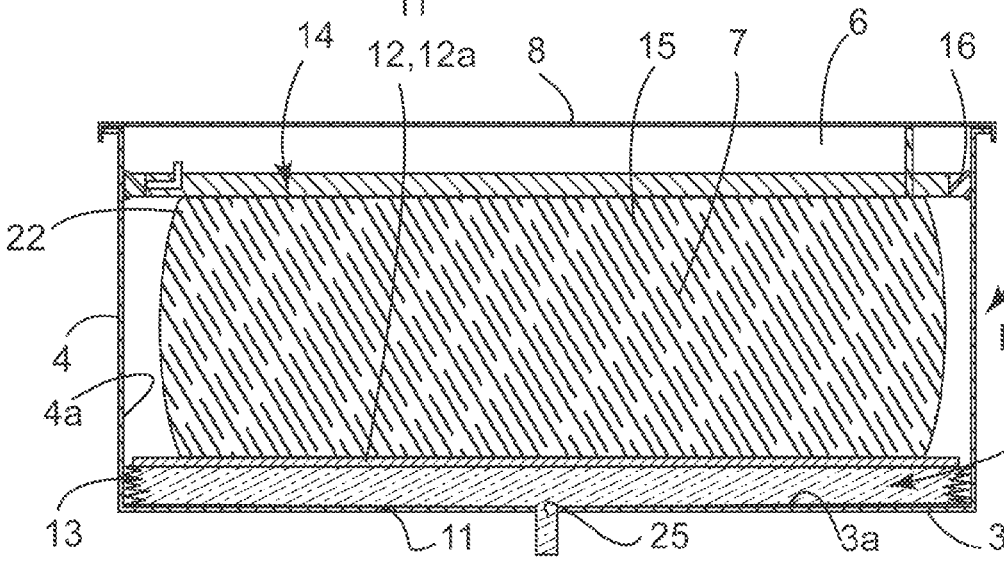

FIGS. 23A, 23B and 23C are three diagrams that illustrate the draining of the flexible 3D pouch.

DETAILED DESCRIPTION OF THE INVENTION

A rigid container 1 according to the invention is specially designed to accommodate and to hold a flexible 3D pouch 2, itself specially designed to contain a biopharmaceutical fluid as defined above.

The rigid container 1, made of plastic or another synthetic or metal material, preferably made of stainless steel, comprises a unit—if necessary that can be removed and re-installed—of several parts in generally solid or substantially solid panels that are flat or substantially flat, as well as connecting pieces for reinforcement, accessories.

Thus, the rigid container 1 comprises a lower transverse wall 3 and an erect side peripheral axial wall 4 in four panels that are two by two in a manner perpendicular or parallel to one another.

In a normal situation, the lower transverse wall 3 is arranged horizontally or essentially horizontally while the erect side peripheral axial wall 4 is arranged vertically or essentially vertically, optionally slightly tapered from the lower transverse wall 3.

The description is given with respect to this situation. It is also in reference to this situation that the words "horizontal," "vertical," "lower," and "upper," . . . should be understood.

Of course, the rigid container 1 can, in some cases, be placed differently, for example for cleaning.

Opposite the lower transverse wall 3, the erect side peripheral axial wall 4 forms and limits an upper transverse opening 6 toward its upper free edge 5.

The opening 6 makes it possible to access a housing 7 of general parallelepipedic or essentially parallelepipedic shape, defined and limited by inner surfaces 3*a* and 4*a* of the lower and side walls 3 and 4, while being open at the location of the opening 6.

Figure 1:
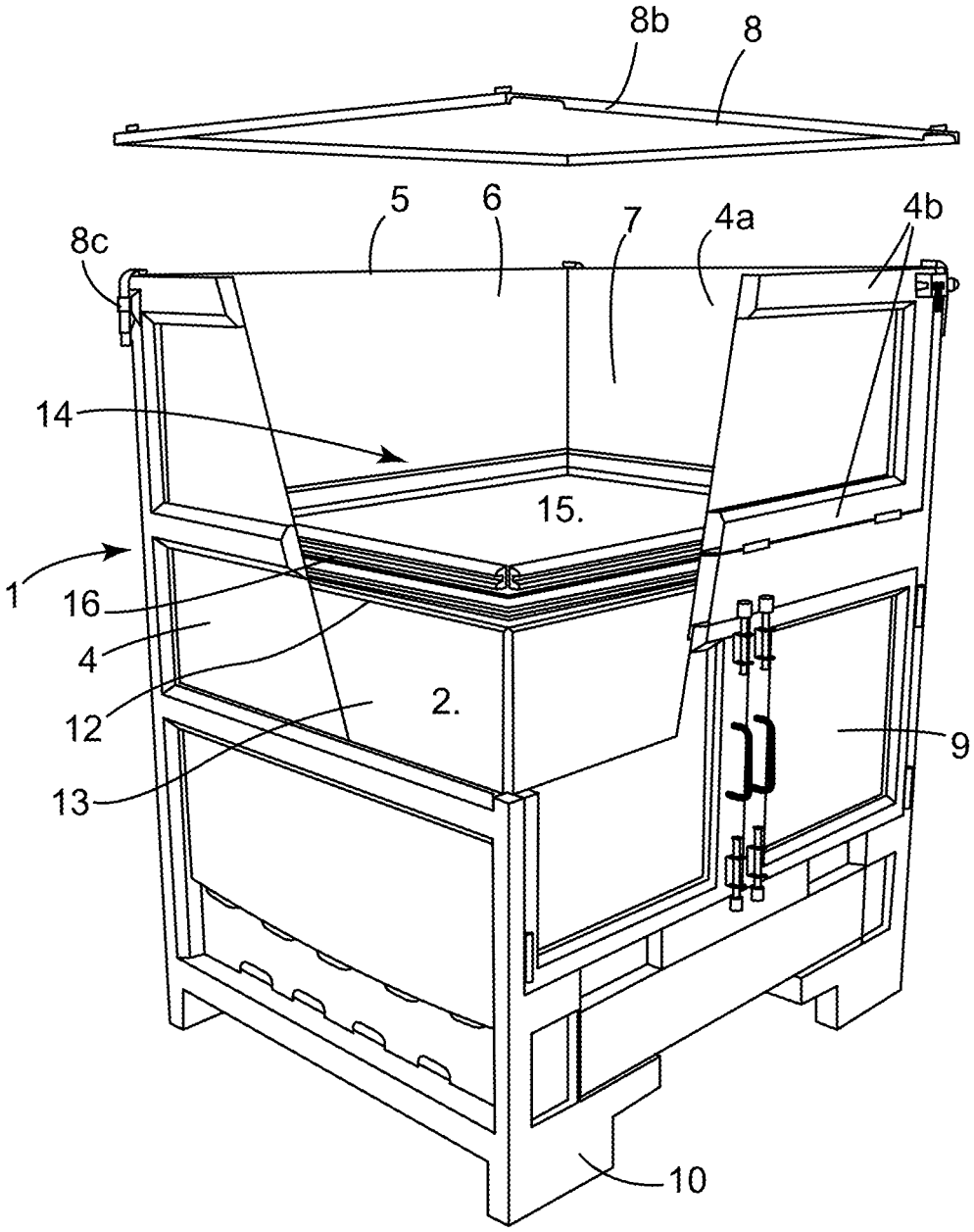
FIG. 1 is a cutaway perspective view that is partially disassembled from a unit that comprises a rigid container in the housing of which a flexible 3D pouch filled with biopharmaceutical product is placed.
Figure 2:
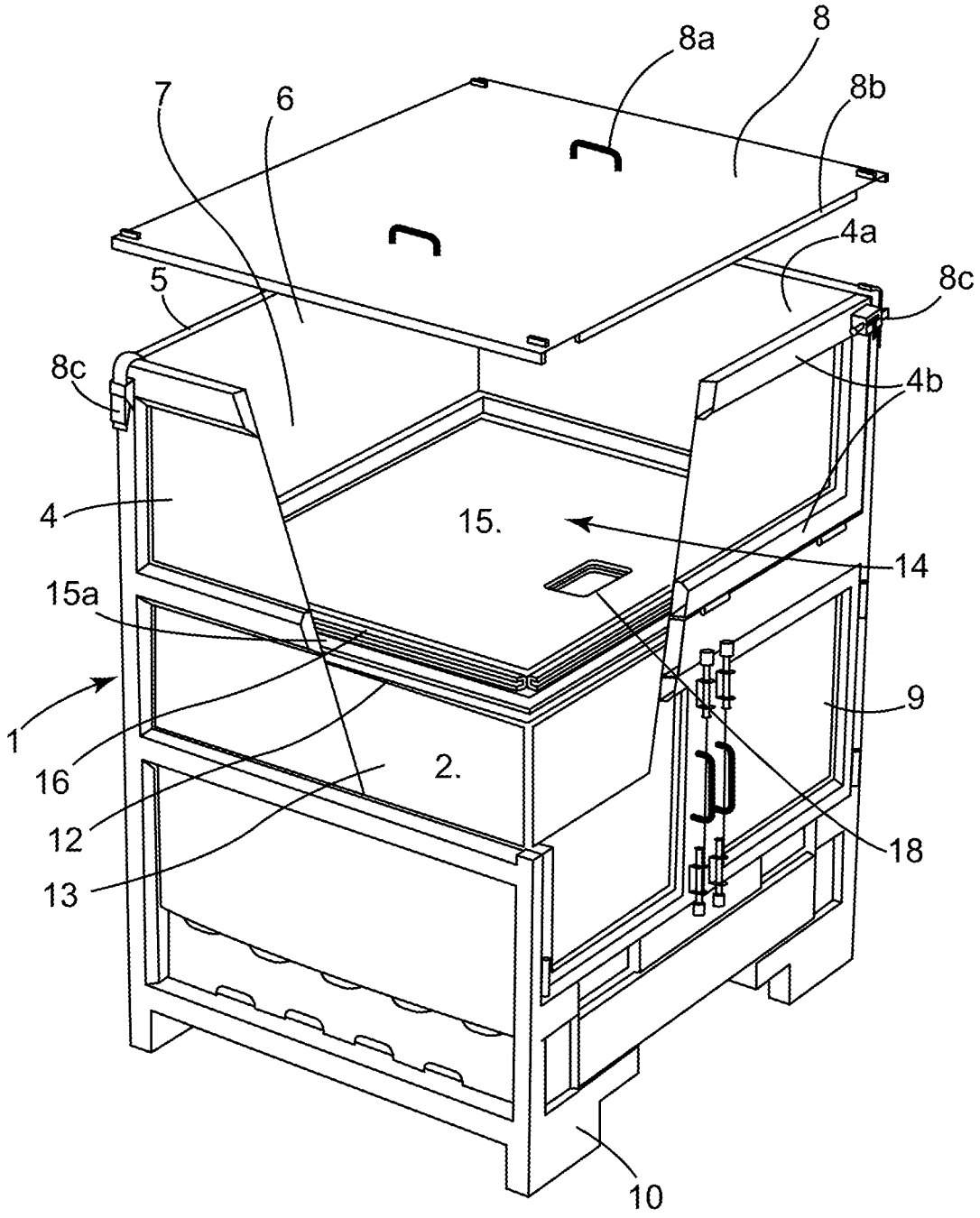
FIG. 2 is a view that is analogous to FIG. 1, under another angle of view and according to a variant in which the containment wall comprises a hole or passage for one or more pipes, connections, tubes or the like, not shown.

In the embodiment shown in FIGS. 1 and 2, the housing 7 has three lengths, horizontally and vertically, of the same order of magnitude but nevertheless different with a large side and a small side, such that the housing 7 has a general shape that is similar to a parallelepiped or essentially a parallelepiped.

As a variant, these lengths can be similar, such that the housing 7 has a general shape that is similar to a cube or essentially a cube.

As appropriate, these lengths can be encompassed between on the order of 400 cm and 1,200 cm, such that the internal volume of the housing 7 can be on the order of 50 liters, but also can reach 1,000 liters, whereby these data are given by way of example but are nonlimiting.

For example, according to typical embodiments, a container can have the following as dimensions: 410×410×520 cm (50 liters) or 1,135×935×1,000 cm or 1,000 liters.

Based on dimensions, the walls 3 and 4 can comprise external reinforcement ribs such as 4*b*.

In the embodiment shown in FIGS. 1 and 2, the rigid container 1 also comprises a removable cover 8 that is equipped with gripping and manipulation elements 8*a*, coming to rest by its edge 8*b* on the free edge 5 of the wall 4. If necessary, quick locking means 8*c* of the cover 8 are provided in closed position, concealing the opening 6.

In the embodiment shown in FIGS. 1 and 2, the rigid container 1 also comprises, on its wall 4 or on one or more of its constituent panels, one or more doors 9, or one or more openings that make it possible to access the interior of the housing 7, and, if necessary, located in such a way as to be able to correspond with ports, openings, and pipes provided on the pouch 3 or combined with it.

If necessary, one or more analogous doors or one or more analogous openings are provided in the lower transverse wall 3 and optionally in the cover 8.

In the embodiment shown in FIGS. 1 and 2, the rigid container 1 also comprises an underframe 10 in the lower part, below the lower transverse wall 3. Such an underframe 10 makes it possible, i.a., to raise the lower transverse wall 3 above the ground and to have access thereto or to make it possible to combine thereto ports, connections, pipes, or the like. Such an underframe 10 also makes it possible to provide spaces for the passage of forks of a palette-type transport vehicle.

The flexible 3D pouch 2 is specially designed for accommodating a biopharmaceutical fluid. Such a pouch 2 comprises a lower end wall 11, an upper end wall 12, and a flexible side wall 13 that can be found in two end states—folded flat and deployed unfolded—and can be deformed for switching from one to the other of these states or for being in any intermediate state.

Such a disposable, biocompatible, flexible 3D pouch 2 can have a large volume of at least 50 liters, up to 1,000 liters, and even more, which justifies the fact that it is described as 3D. Such a pouch is described in, for example, the International Application WO00/04131, whereby this embodiment is not exclusive of others.

Of course, the dimensions of the rigid container 1 and those of the flexible 3D pouch 2 are suitable, such that the housing 7 of the rigid container 1 is able to accommodate the flexible 3D pouch 2.

When the flexible 3D pouch 2 is filled with biopharmaceutical fluid, it is inflated, more or less greatly. Whereas its lower wall 11 can rest on the inner surface 3*a* of the wall 3 of the rigid container 1, its side wall 13 comes to be applied against the inner surface 4*a* of the side wall 4 of the rigid container 1.

The 3D pouch 2 comprises one or more inlet or intake or filling openings, in particular in the form of ports, not shown, in particular on the upper wall 12, able to be closed when necessary, and one or more outlet or evacuation or drain openings 25 (FIGS. 23A, 23B and 23C) in particular on the lower wall 11, in particular in the form of ports, able to be opened when necessary. The rigid container 1 is arranged to allow access to these openings.

The rigid container 1 also comprises containment means 14 that comprise a containment wall 15 that is movable, and, if necessary, removable.

The containment wall 15 is arranged in such a way as to be able to be arranged transversely in a general horizontal or essentially horizontal direction, in the housing 7, at any level or height desired between the lower transverse wall 3 and the upper free edge 5 or the opening 6 or the cover 8 when it is provided.

Furthermore, horizontally, the containment wall 15 has two lengths that are defined based on corresponding lengths of the housing 7 in such a way that between the outside peripheral free edge 15*a* of the containment wall 15 and the inner surface 4*a* of the side wall 4 opposite the rigid container 1, the transverse gap is limited, for example on the order of a centimeter. For example, the containment plate has a general rectangular or square shape.

The containment wall 15 is arranged in such a way as, on the one hand, to be able to be applied with a certain downward vertical axial force against the upper outside surface 12*a* of the transverse upper wall 12 of the 3D pouch 2—and to absorb the opposite reaction force—and, on the other hand, to be held fixed in this application position by holding means 16 that are then in the active state.

The rigid container 1 therefore also comprises holding means 16.

As indicated, these holding means 16, when they are in the active state, hold fixed in position the containment wall 15 that is applied with a certain force against the upper outside surface 12*a* of the transverse upper wall 12 of the 3D pouch 2.

Contrary to known arrangements of the prior art in which such holding means are arranged with respect to the rigid container in an axial vertical way, in this invention, the holding means 16 are arranged transversely in the rigid container 1, i.e., in general horizontally or essentially horizontally.

Furthermore, the holding means 16 are borne not by the walls that comprise the container, but are borne by the containment means 14 of which they are part, in a structural and functional combination.

The holding means 16 are arranged in such a way as to be movable or deformable in the transverse direction, i.e., in general horizontally or essentially horizontally, between an inactive retracted state and an active expanded state.

Figure 4A:
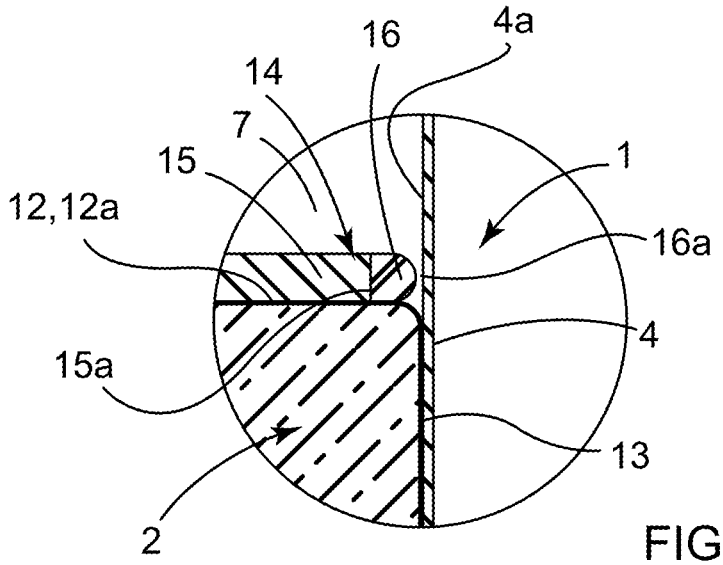
FIGS. 4A and 4B are two partial views, on a larger scale, illustrating respectively the holding means in the inactive retracted state and in the active expanded state.

In the inactive retracted state, as illustrated by FIG. 4A, a distal end part 16*a* of the holding means 16 is separated from the inner surface 4*a* of the side wall 4 opposite the rigid container 1, such that the holding means 16 then are not held fixed in position with respect to the walls 3, 4 of the rigid container 1.

Figure 4B:
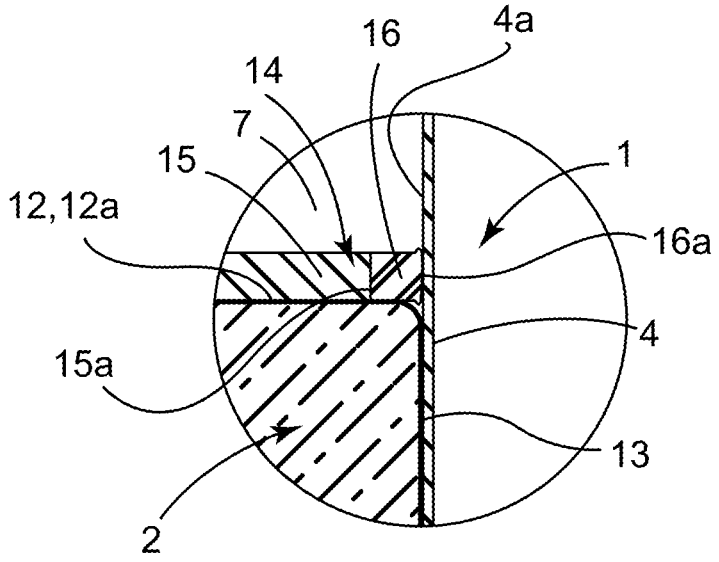

In contrast, in the active expanded state, as illustrated by FIG. 4B, the distal end part 16*a* is applied against the inner surface 4*a* of the side wall 4 opposite the rigid container 1 without any chance of inadvertent sliding. Thus, in the active expanded state, the holding means 16 are held fixed in position with respect to the walls 3, 4 of the rigid container 1.

On the other hand, the holding means 16 are arranged in such a way as to be able to be applied at any desired location of a continuous zone 17 of the inner surface 4*a* of the side wall 4, according to a continuous variation. This zone 17 is extended in the vertical axial direction, in particular over the entire height or essentially the entire height of the rigid container 1, in such a way that the containment wall 15 can be placed in the housing 7 at any desired distance—varying continuously—from the lower transverse wall 3 or at any desired distance from the upper transverse opening 6.

Figure 5:
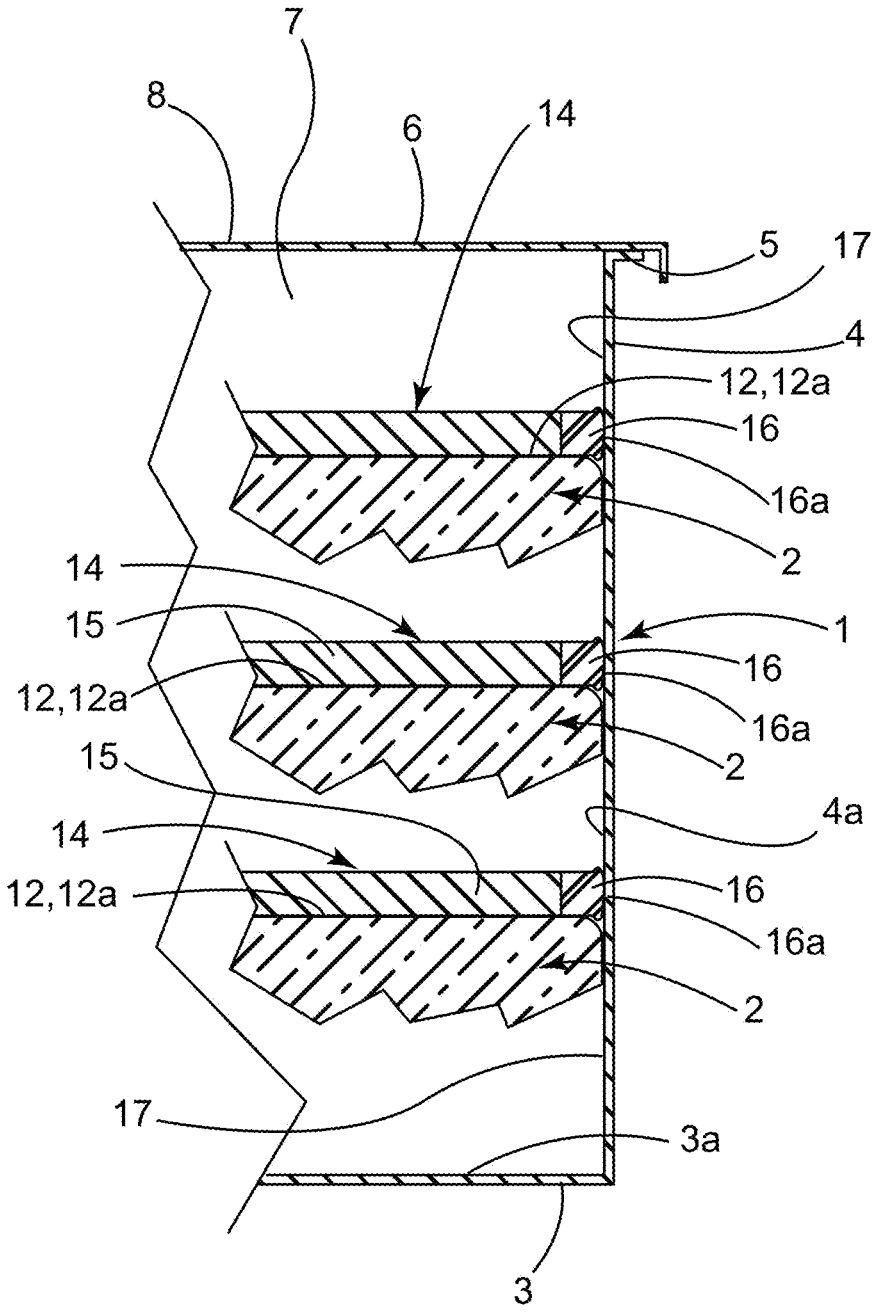
FIG. 5 is a partial diagram that is analogous to FIG. 4 and that on a larger scale illustrates three possible different positions of the containment means and the continuous zone for application of the holding means.

FIG. 5 illustrates three possible particular different positions in height of the containment plate 15, corresponding to three different volumes of the biopharmaceutical product contained in the flexible 3D pouch 2, namely a volume V1, a volume V2 that is greater than V1, and a volume V3 that is greater than V2.

As a result of the preceding, the containment wall 15 can be applied and held with a certain axial force against the upper outside surface 12*a* of the transverse upper wall 12 of the 3D pouch 2, regardless of how full the latter is, with this degree of filling able to vary continuously.

The rigid continuer 1 as it was just described can be the object of different embodiments.

Thus, in the embodiment shown in FIG. 1, the containment wall 15 is solid. In the embodiment of FIG. 2 or other derived embodiments, the containment wall 15 comprises one or more holes, cutouts or pipe passages 18, connections, pipes, or the like, not shown, that are functionally combined with or designed to be functionally combined with the flexible 3D pouch 2.

In the embodiment shown in FIG. 4, the containment wall 15 has a certain thickness or excess thicknesses, such that it is inherently rigid enough and able, in itself, to absorb the force exerted on the flexible 3D pouch 2 without substantial deformation.

In the embodiment shown in FIGS. 6A and 6B, the containment wall 15 is not inherently rigid enough and able, in itself, to absorb the force exerted on the flexible 3D pouch 2 without substantial deformation. In this case, it is provided that the containment means 14 also comprise stiffening means 19.

The stiffening means 19 are arranged in such a way that when they are active, they act on the containment wall 15 to stiffen it enough so that, thus stiffened, it is able to absorb the force exerted on the flexible 3D pouch 2 without substantial deformation.

In the variant embodiment of FIGS. 6A and 6B, the stiffening means 19 are in the form of a stiffening chamber 19*a* that is placed above and adjacent to the containment wall 15, which is generally a solid plate. This stiffening chamber 19*a* is deformable and substantially inelastic. It can be made active by being filled with a fluid that is brought to it via an inlet/outlet port 19*b* (see FIGS. 9A and 9B) in such a way as to provide in general a certain overall stiffness that in turn imparts the necessary overall stiffness to the containment plate 15. In this embodiment, means for filling and draining the stiffening chamber 19*a*, able to be combined with the inlet/outlet port 19*b*, are also provided.

In the variant embodiment of FIGS. 7A and 7B, the stiffening means 19 are in the form of a stiffening chamber 19*a* placed below and adjacent to the containment wall 15.

In the variant embodiment of FIGS. 8A and 8B, the containment wall 15 is generally not a solid plate as above but in the shape of a frame forming an opening 20, whereby the stiffening chamber 19*a* is placed in this opening 20.

In the variant embodiment of FIGS. 6A and 6B, the containment wall 15 is separate but applied against the lower surface of the stiffening chamber 19*a*. In the variant embodiment of FIGS. 7A and 7B, the containment wall 15 is separate but applied against the upper surface of the stiffening chamber 19*a*.

In the variant embodiment of FIGS. 10A and 10B, the containment wall 15 is part of the lower wall of the stiffening chamber 19*a*.

As appropriate, a single stiffening chamber 19*a* or several chambers are provided. In contrast, unless it is not possible, combining the different variants described above can be considered.

Figure 3:
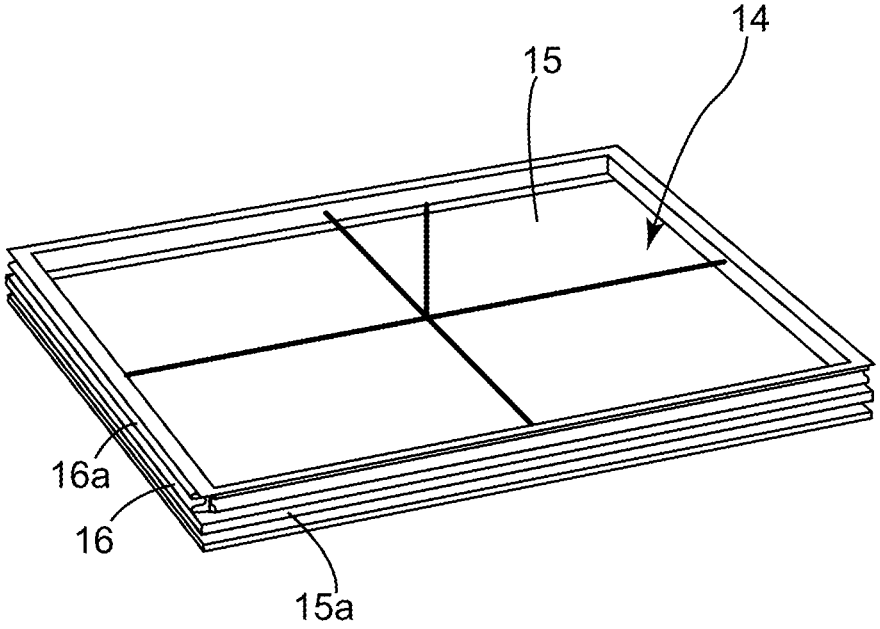
FIG. 3 is a general perspective view of an embodiment of the containment means of the rigid container.

According to another possible variant that is illustrated by FIGS. 11A, 11B, 12A, and 12B, the holding means 16 are borne by the stiffening means 19, when such means are provided. When such stiffening means 19 are not provided, the holding means 16 are borne by the containment wall 15, as illustrated by, for example, FIG. 3.

According to a possible embodiment, the containment means 14 are inherently heavy enough and able, in themselves, to exert by their own weight the desired force on the flexible 3D pouch 2.

According to another possible embodiment, in contrast, the containment means 14 are not inherently rigid enough and able, in themselves, to exert by their own weight the desired force on the flexible 3D pouch 2.

In this case, it is provided that the containment means 14 also comprise additional suitable means for application of such a force. These means, when they are active, are able to act on the containment wall 15 to exert on it a force such that the containment means 14 in turn exert the desired force on the flexible 3D pouch 2. Such means for application of a force are, according to the embodiments considered, manual or human means, or else a cylinder, or else heavy weights.

According to another possible embodiment, the containment means 14 comprise:

Below, the containment wall 15,

Above, a support element 21, extended transversely, i.e., horizontally or essentially horizontally, placed perpendicular to the containment wall 15, bearing the holding means 16, And, interposed between the containment wall 15 and the support element 21 and combined with them structurally and functionally, means 22 for rigid connection and transmission of forces.

These rigid connecting means 22 are able to ensure a rigid connection for transmission of the desired force to the flexible 3D pouch 2 between the containment wall 15 and the support element 21.

According to a variant of this embodiment, the means 22 for rigid connection and transmission of forces are substantially non-deformable.

Figure 13A:
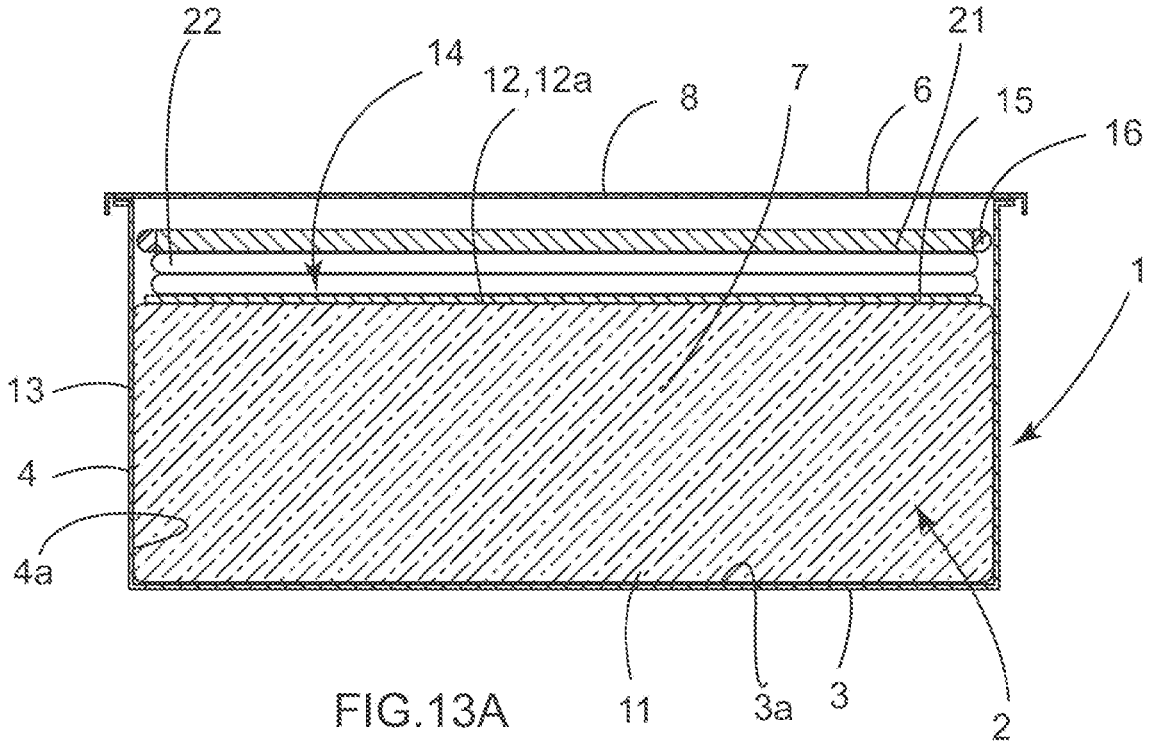
Figure 13B:
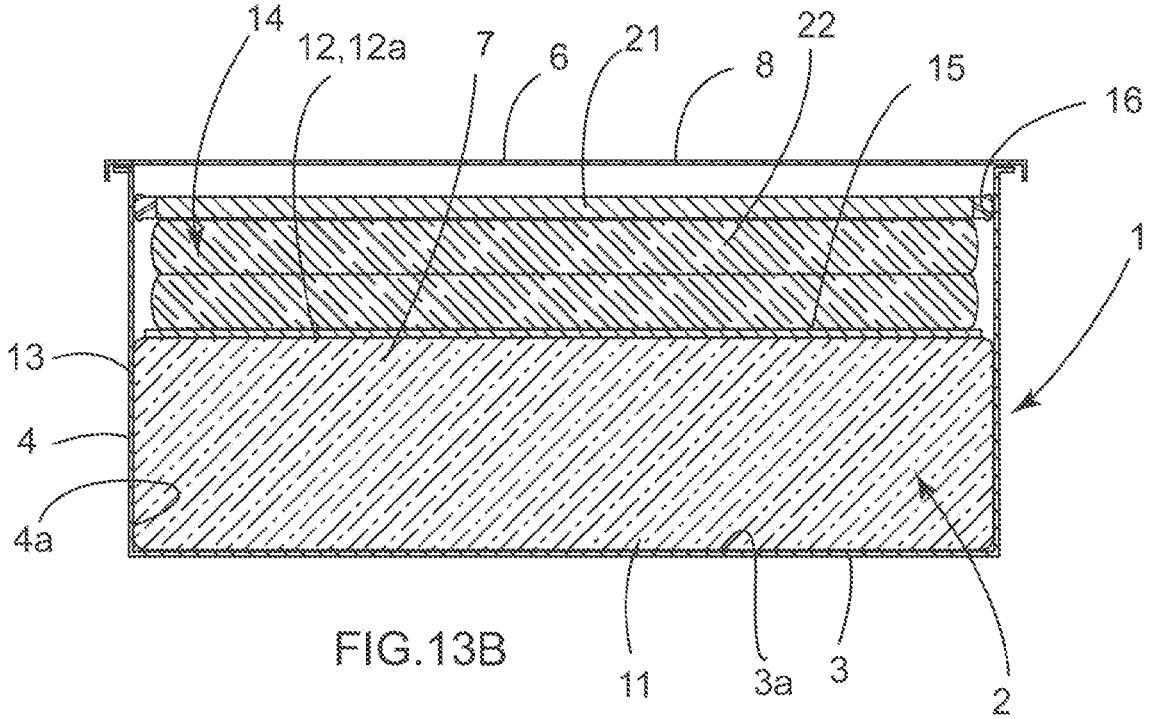

According to another variant, illustrated by, for example, FIGS. 13A and 13B, the means 22 for rigid connection and transmission of forces are deformable between two end states, namely a retracted state (FIG. 13A) and an expanded state (FIG. 13B).

In the retracted state, the containment wall 15 is brought closer to the means 16 for holding that are borne by said support element, whereas in the expanded state, it is moved farther away.

Furthermore, suitable maneuvering means are provided that can switch the deformable means 22 for rigid connection and transmission of forces between their two end states. Such maneuvering means consequently constitute means for relative movement of the containment wall 15 with respect to the support element 21 for bringing it closer thereto or moving it away therefrom.

According to one embodiment, in the retracted state of the means 22 for rigid connection and transmission of forces, the containment wall 15 is located close to the support element, which provides to the unit a great compactness in the vertical axial direction.

According to another embodiment, which can be combined with the preceding embodiment, in the expanded state of the means 22 for rigid connection and transmission of forces, the containment wall 15 is located close to the lower transverse wall 3 of the rigid container 1. This constructive arrangement makes it possible to evacuate the biopharmaceutical product via an evacuation port 25 that is provided on the lower wall 11 of the flexible 3D pouch 2, until the pouch 2 is completely drained.

The support element 21 can be the object of different variant embodiments.

In the case of FIGS. 13A and 13B, the support element 21 is a rigid plate, having dimensions such that the transverse gap between its outside peripheral free edge and the inner surface 4*a* of the side wall 4 opposite the rigid container 1 is limited.

Figure 14A:
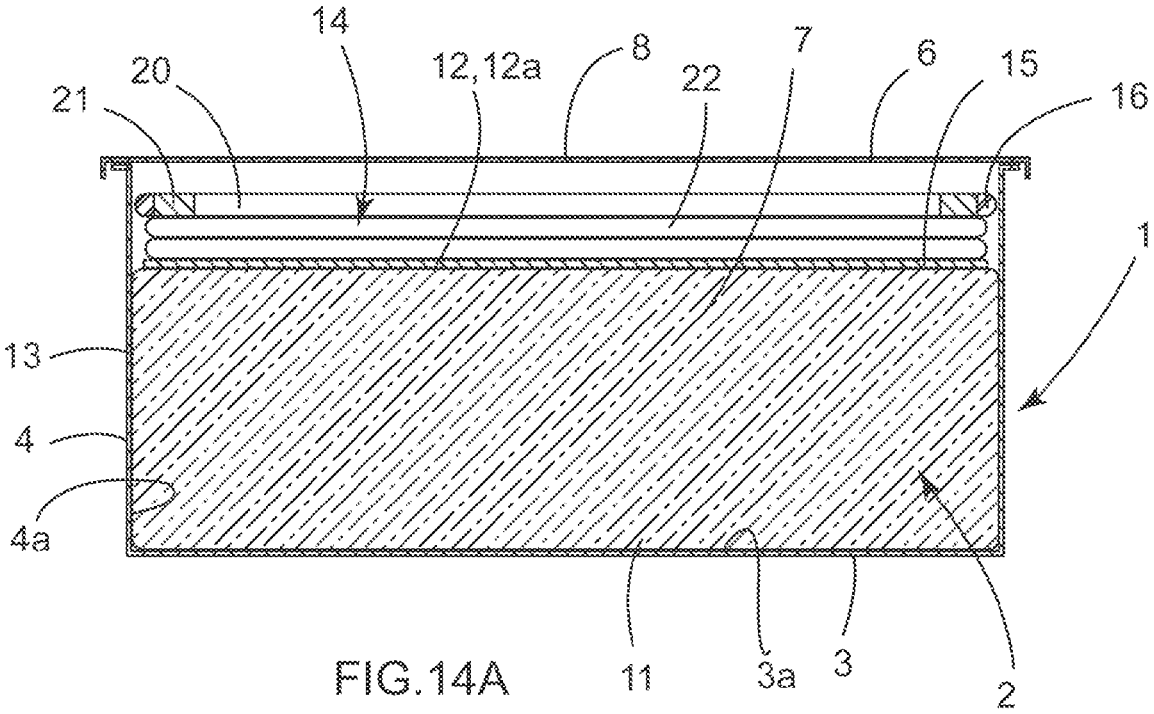
Figure 14B:
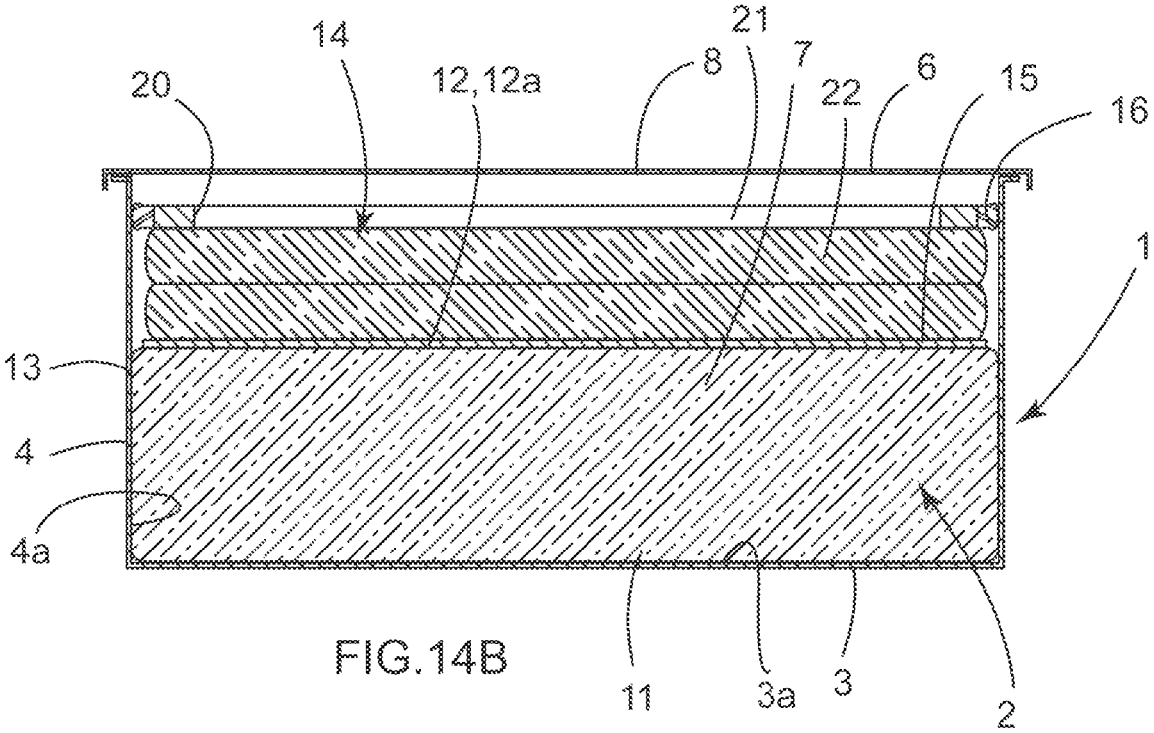
Figure 15A:
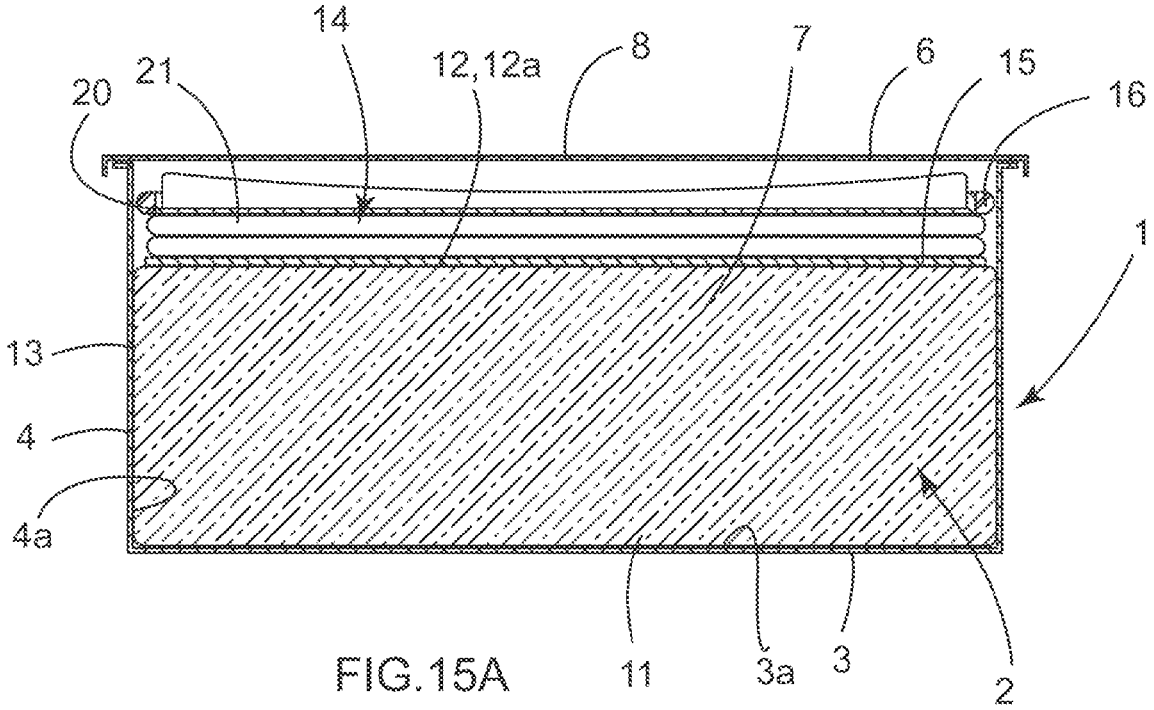
Figure 15B:
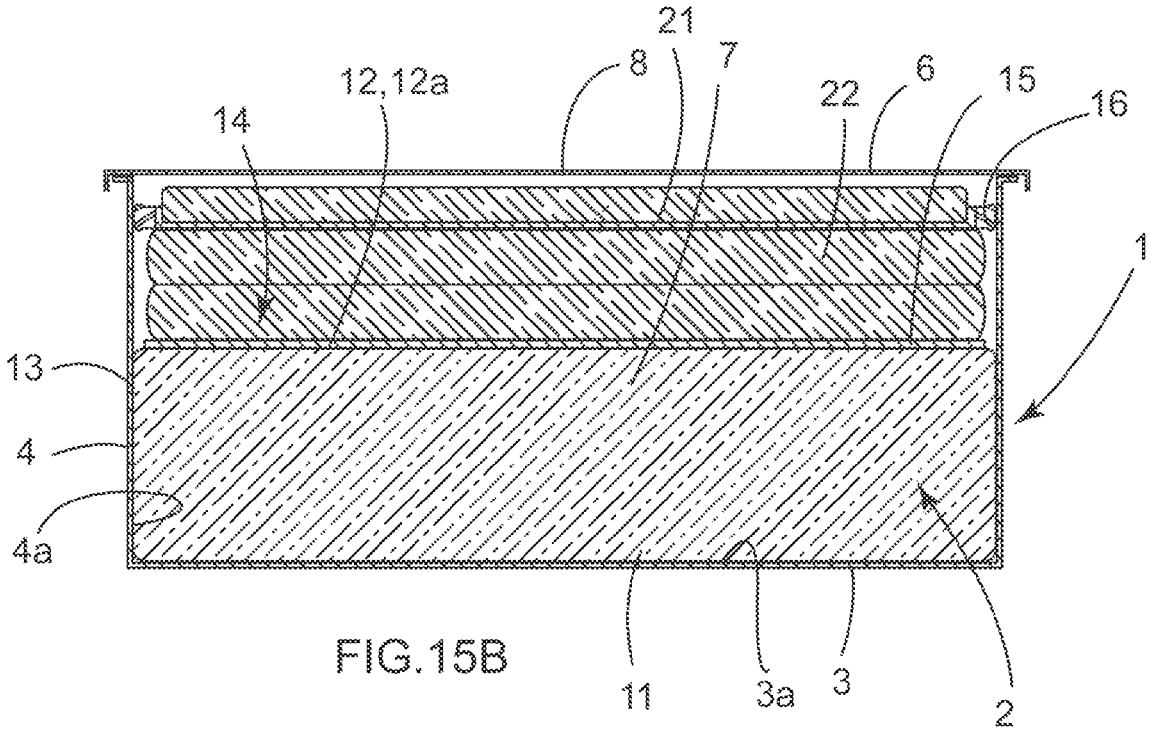
Figure 16A:
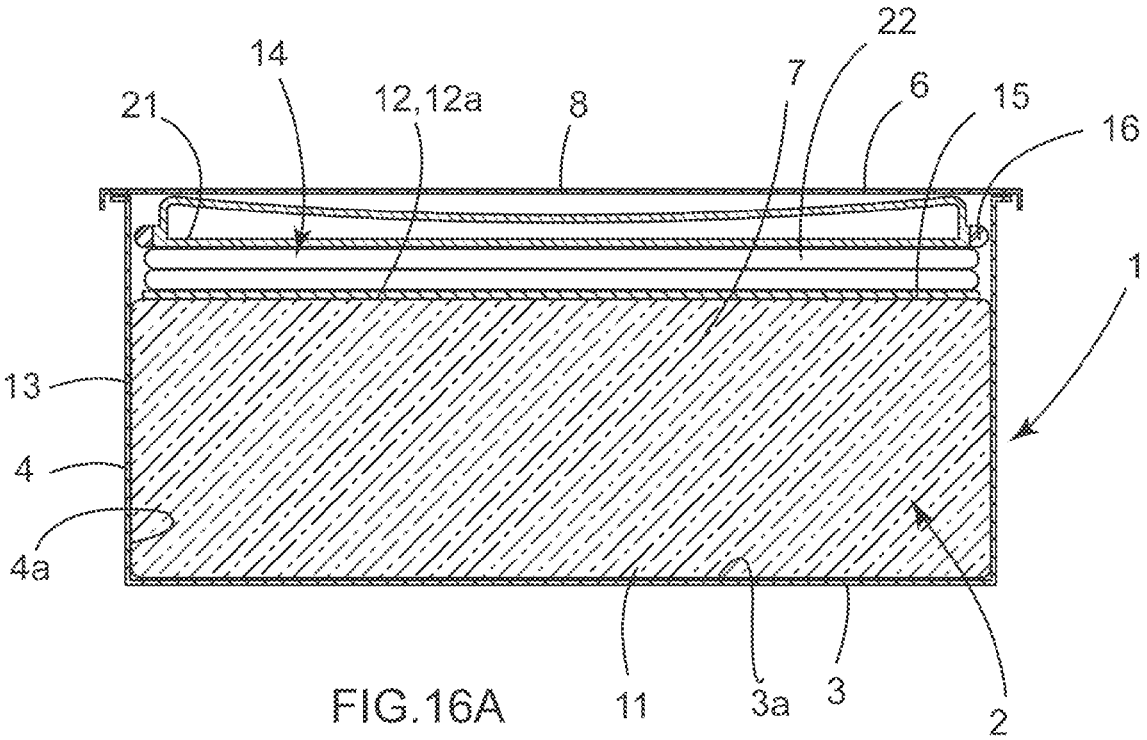
Figure 16B:
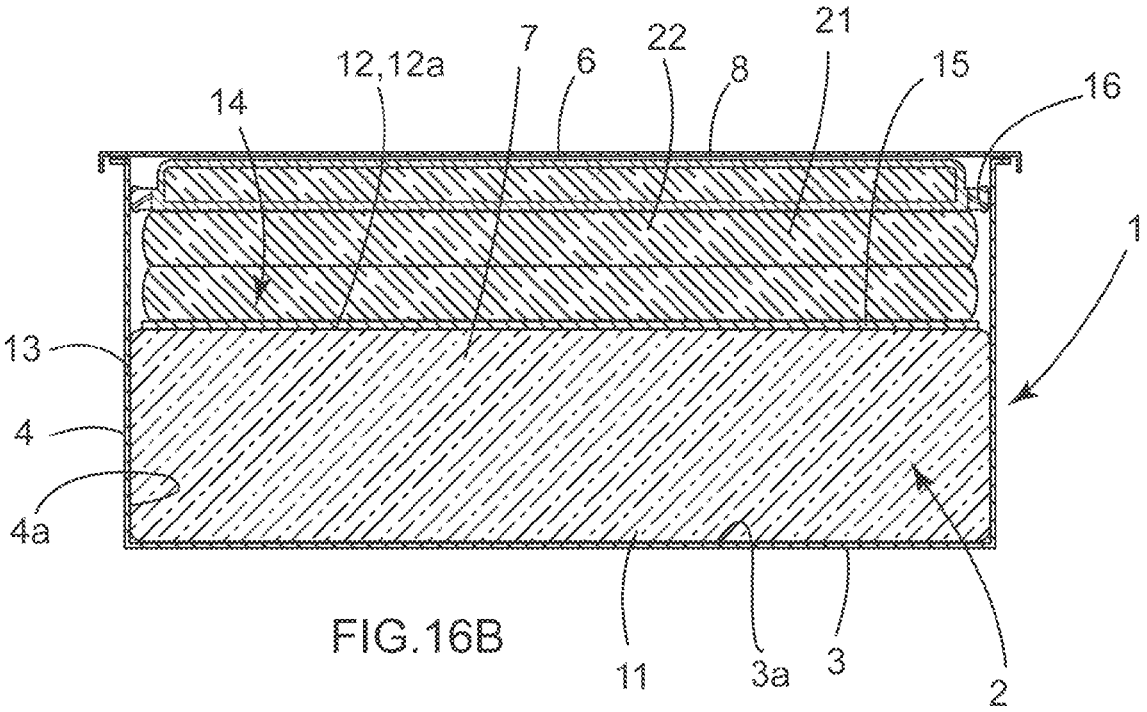

In the case of FIGS. 14A and 14B, the support element 21 is a rigid frame.

In the case of FIGS. 15A and 15B and 16A and 16B, the support element 21 is a deformable chamber and substantially inelastic, made rigid by being filled with a fluid, provided with an inlet/outlet port for the filling fluid (not shown), with filling and draining means being able to be combined with the inlet/outlet port.

The relative movement means formed by the deformable connecting means 22 can be the object of different variant embodiments.

Figure 17A:
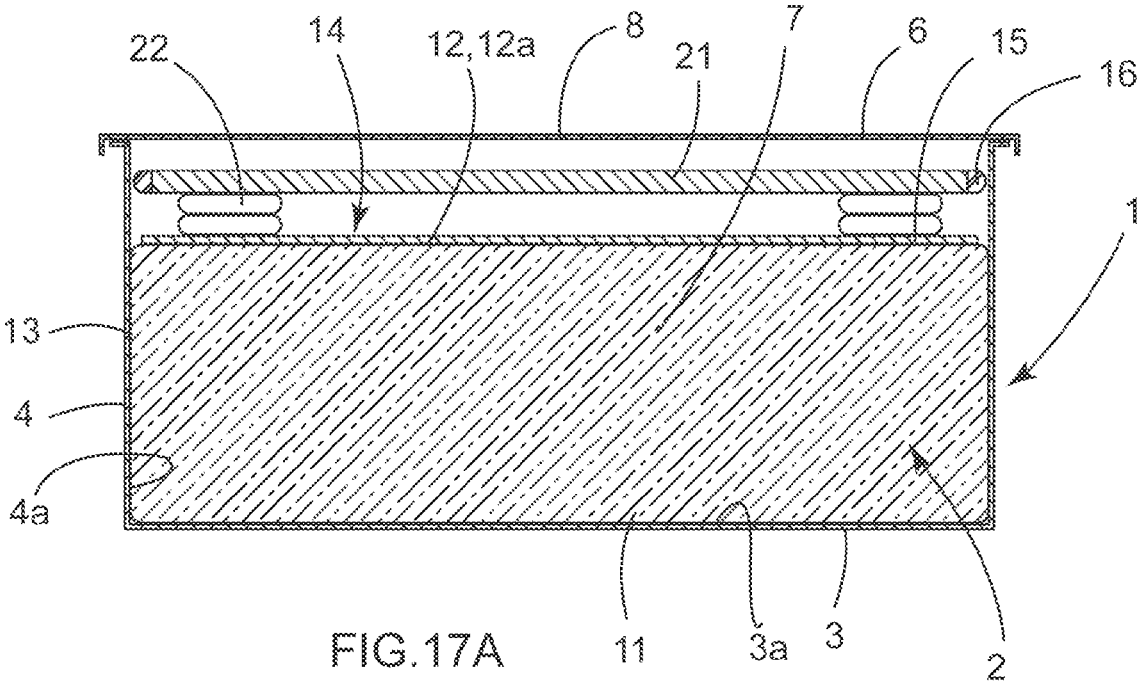
Figure 17B:
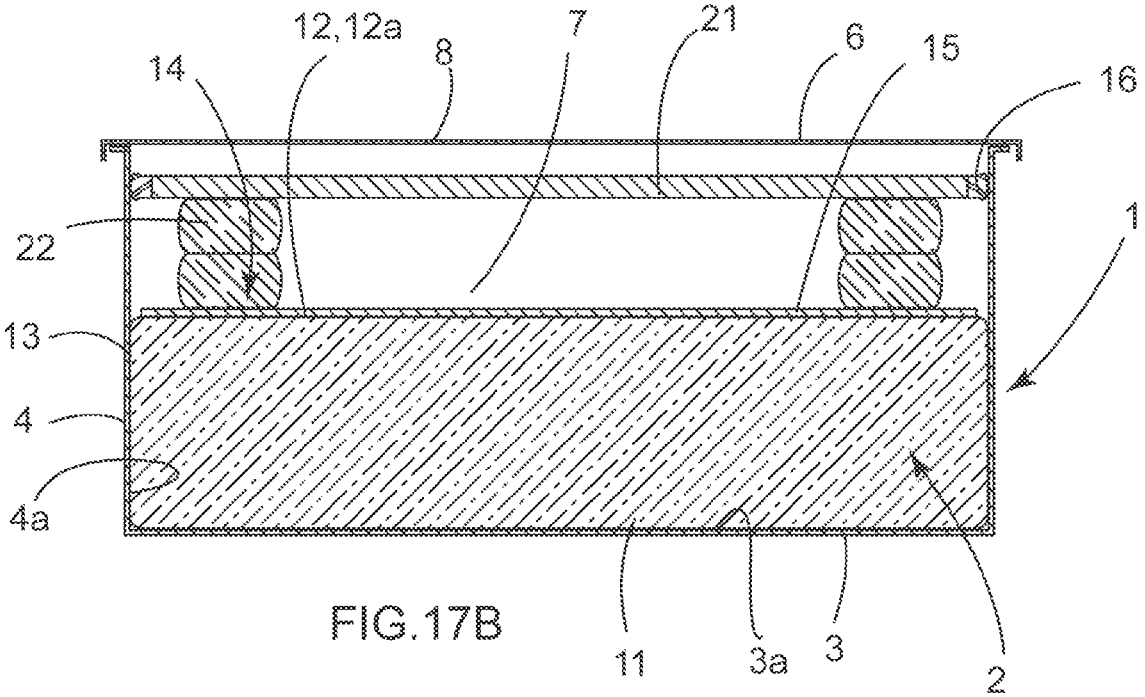

In the case of FIGS. 17A and 17B, the relative movement means 22 comprise two cylinders.

Figure 18A:
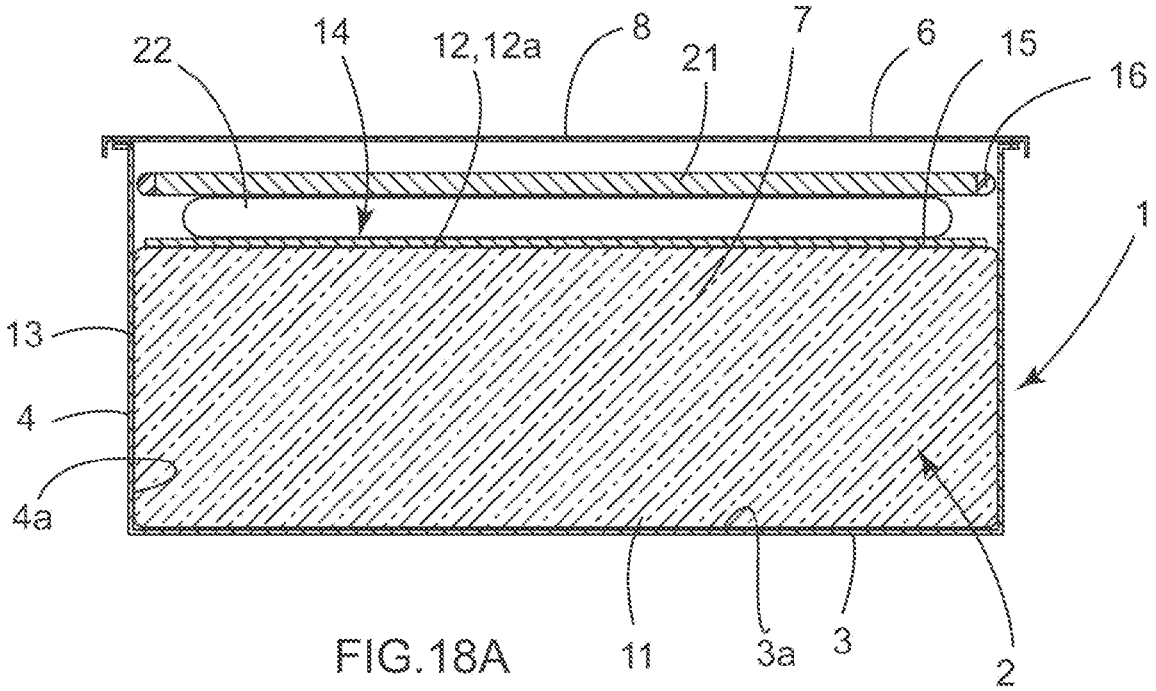
Figure 18B:
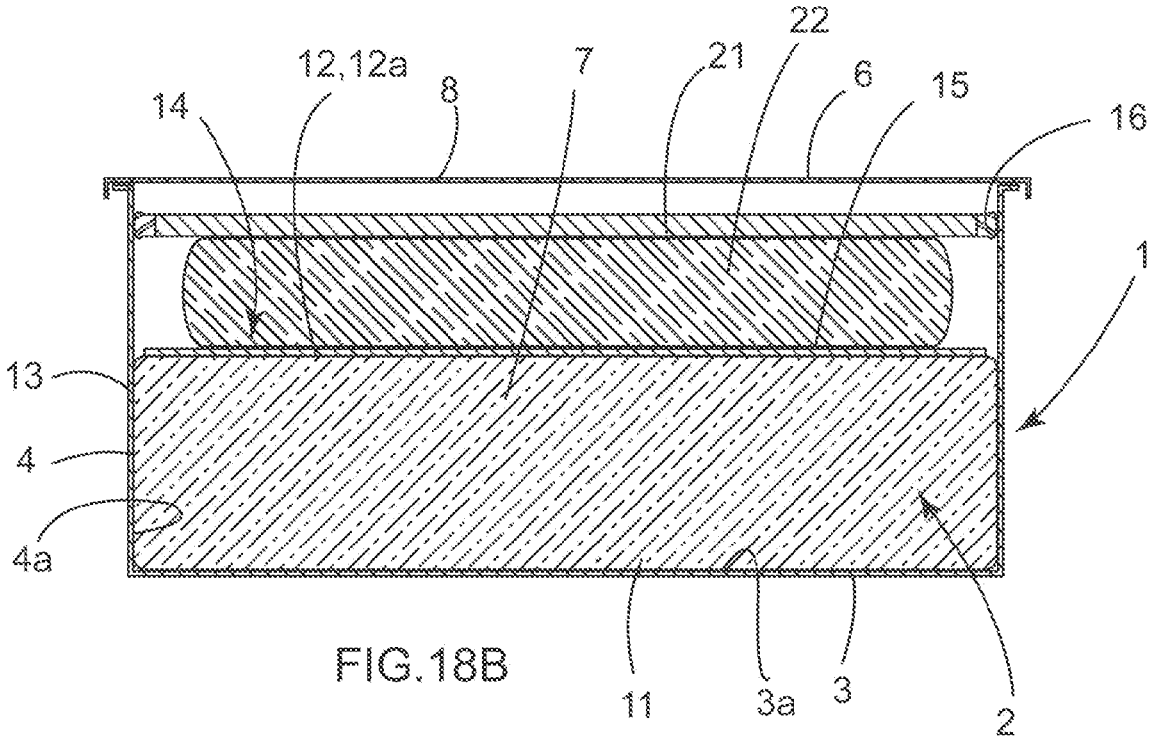

In the case of FIGS. 18A and 18B, the relative movement means 22 comprise a deformable chamber that is made more or less flat or more or less expanded by a more or less significant filling with a fluid, whereby this chamber 22 is provided for this purpose with an inlet/outlet port for filling fluid, with means for filling and draining being provided that can be combined with the inlet/outlet port.

According to other possible variant embodiments, the containment wall 15 is either structurally separate from the flexible 3D pouch 2 or, in contrast, is a structural part of it.

According to one embodiment, the lower surface of the containment wall 15 lacks rough spots that are likely to damage the flexible 3D pouch 2.

According to one embodiment that is illustrated by FIG. 19, an elastically deformable element 23, such as a plate made of alveolar material, designed to assume the shape of the surface 12*a* of the upper wall 12 of the flexible 3D pouch 2, is combined with the containment wall 15.

With a rigid container 1 as it was just described, it is possible to implement conventional flexible 3D pouches 2 without the latter needing to be adapted for this purpose.

It is also possible to provide for implementing flexible 3D pouches 2 that are specially adapted to the rigid container 1 that is provided with the containment means 14 described above, such a 3D pouch 2 comprising, combined structurally, toward the upper wall 12, at least a portion of the containment means 14.

For example, the flexible 3D pouch 2 can include the containment wall 15 in a structural way.

In a possible embodiment illustrated by FIG. 20, the flexible 3D pouch 2 incorporates an inherently rigid containment wall 15.

Figure 21A:
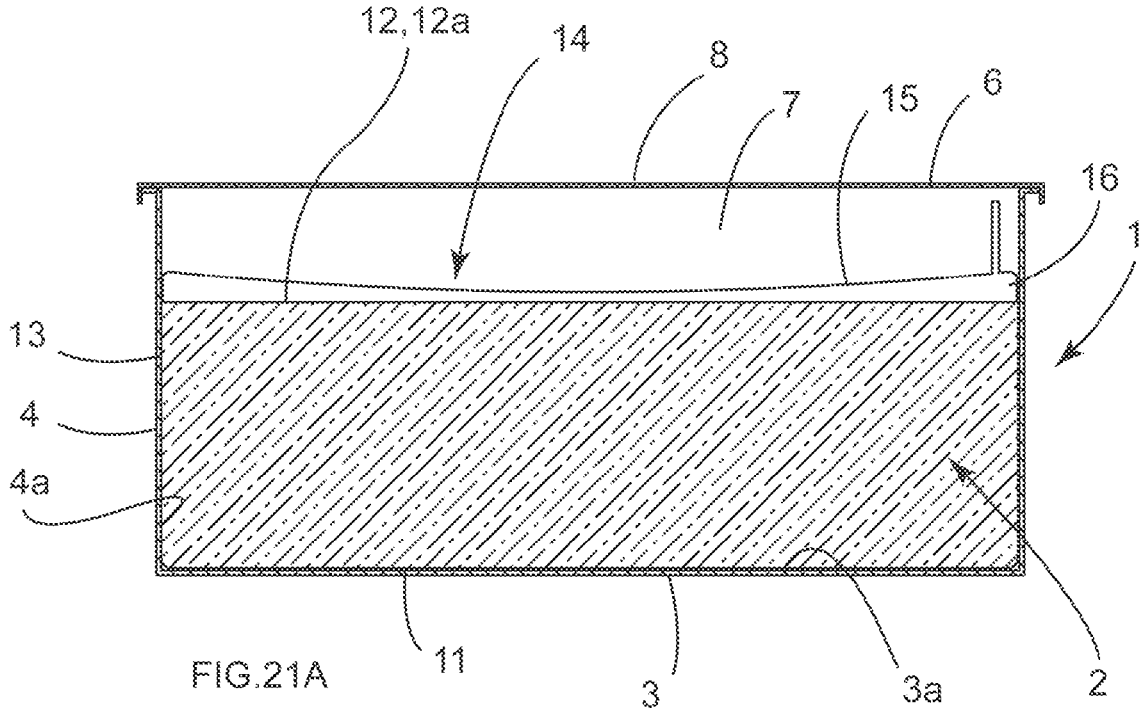
Figure 21B:
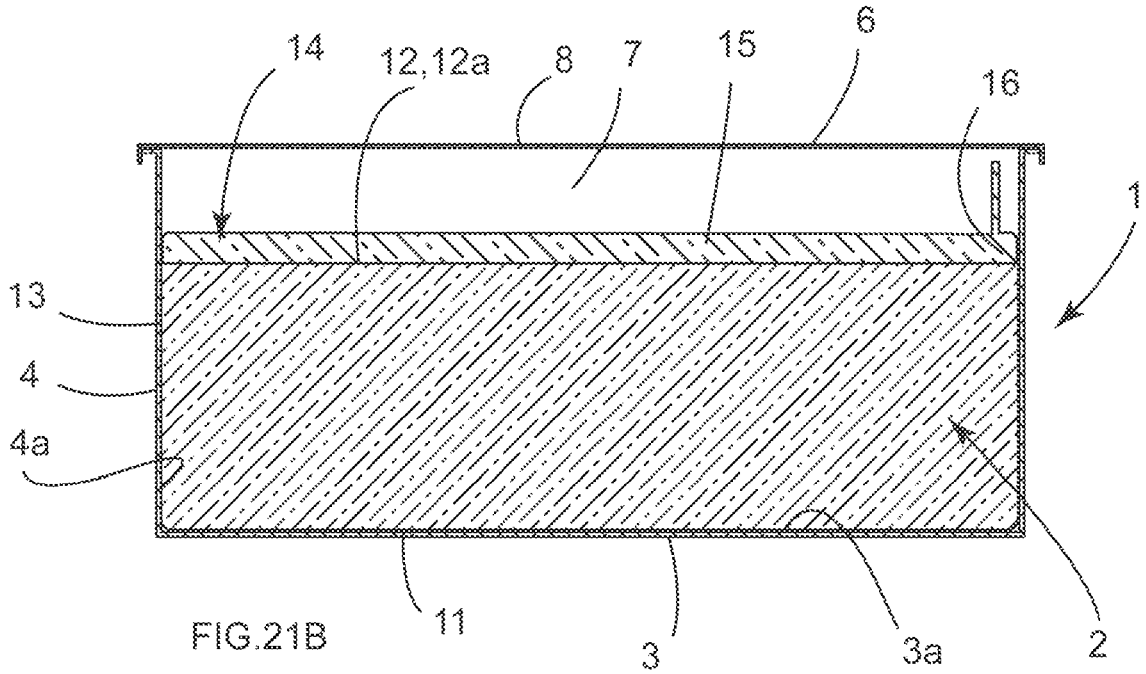

In another possible embodiment that is illustrated by FIGS. 21A and 21B, the flexible 3D pouch 2 incorporates a containment wall 15 that is not inherently rigid, as it was described above, and it comes in the form of a stiffening chamber. In such an embodiment, the flexible 3D pouch 2 is part of the lower wall of such a stiffening chamber that is placed above the containment wall 15 itself. As already described, such a deformable and substantially inelastic stiffening chamber is made rigid and active by being filled with a fluid.

Figure 22A:
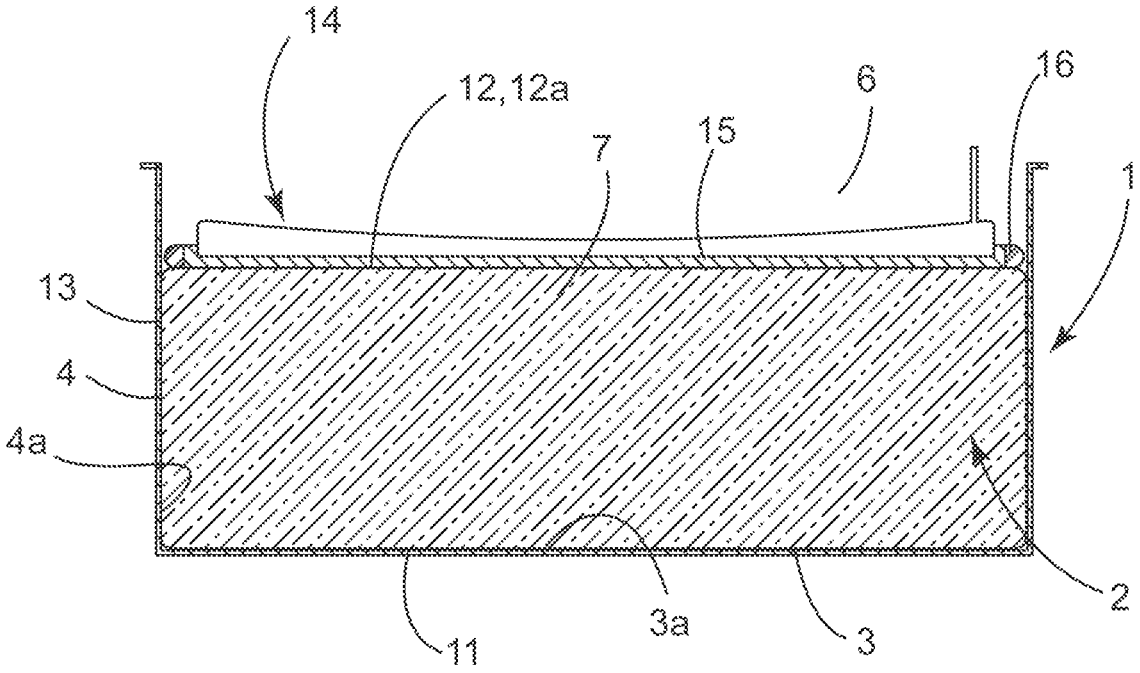
Figure 22B:
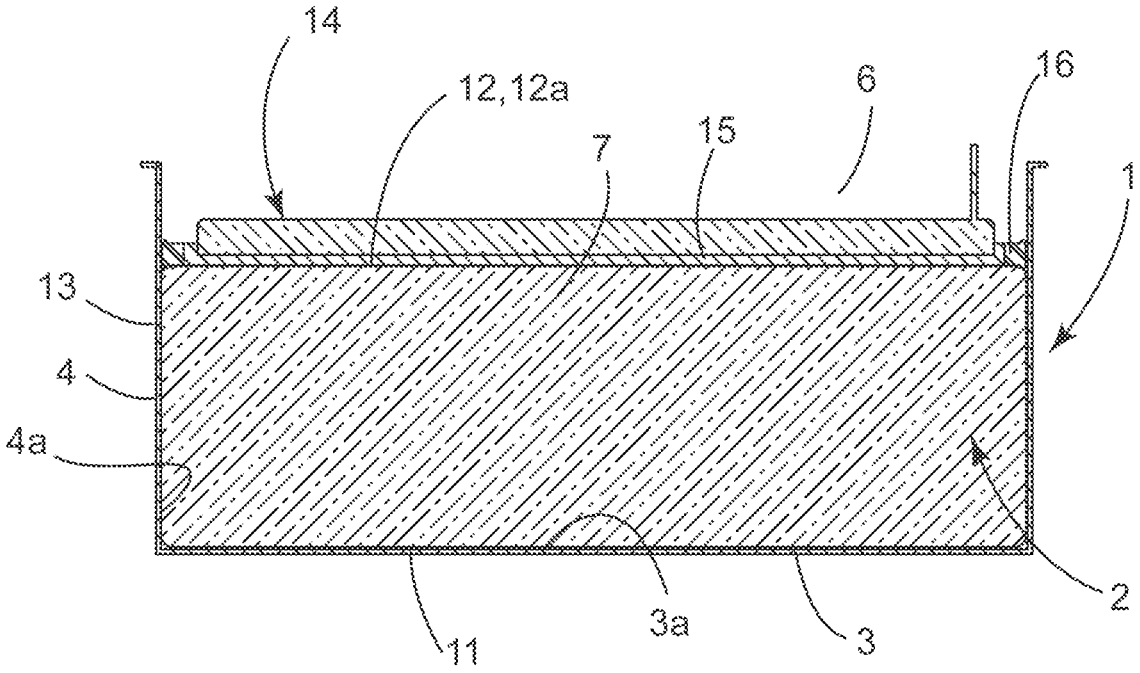

In the embodiment that is illustrated by FIGS. 22A and 22B, the flexible 3D pouch 2 incorporates a containment wall 15 that supports the holding means 16, with a chamber also being provided for stiffening the containment wall 15.

In addition to the rigid container 1 and the flexible 3D pouch 2, the invention also relates—in that it incorporates at least a portion of the containment means 14—to the process for implementing such a rigid container, as it was described above.

In a first variant embodiment, the process comprises the following successive stages:

An empty flexible 3D pouch 2 is provided;

The empty flexible 3D pouch 2 is placed in the housing 7 of the rigid container 1 in such a way that it can be deployed in the latter;

The flexible 3D pouch 2 is filled through an opening that is provided for this purpose, to introduce therein a certain quantity of biopharmaceutical fluid, with the pouch 2 thus being at least partially deployed, its side wall 13 being contained by the side wall 4 of the rigid container 1, and then the opening of the thus filled pouch 2 is sealed;

At any moment and regardless of how full the flexible 3D pouch 2 is, the containment means 14, whose holding means 16 are in the inactive refracted state, are brought transversely into the housing 7 of the rigid container 1 until the containment wall 15 comes against the surface 12*a* of the upper wall of the flexible 3D pouch 2, and is applied on it with a certain axial force;

In this situation, the holding means 16 are switched from the inactive retracted state to the active expanded state, and thus the distal end part 16*a* is locked on the inner surface 4*a* of the side wall 4 opposite it, without any chance of inadvertent sliding, at any corresponding location of the continuous zone 17.

In another possible embodiment, the following stages are initiated:

An empty flexible 3D pouch 2 is provided;

The empty flexible 3D pouch 2 is placed in the housing 7 of the rigid container 1 in such a way that it can be deployed in the latter;

The containment means 14, whose holding means 16 are in the inactive retracted state, are brought transversely into the housing 7 of the rigid container 1 until the containment wall 15 comes against the surface 12*a* of the upper wall of the flexible 3D pouch 2;

The flexible 3D pouch 2 is filled through an opening to introduce therein a certain quantity of biopharmaceutical fluid, with the pouch 2 thus being at least partially deployed, its side wall 13 being contained by the side wall 4 of the rigid container 1, and then the opening of the thus filled pouch 2 is closed;

In this situation, the holding means 16 are switched from the inactive retracted state to the active expanded state, and thus the distal end part 16*a* is locked on the inner surface 4*a* of the side wall 4 opposite it, without any chance of inadvertent sliding, at any corresponding location of the continuous zone 17.

In the case where means 22 for relative movement of the containment wall 15 with respect to a support element 21 are provided, the process is such that when the containment means 14 are brought into the housing 7 of the rigid container 1 and when the holding means 16 are switched from the inactive retracted state to the active expanded state, the means 22 for relative movement of the containment wall 15 with respect to the support element 21 are controlled so that they are in the retracted state.

FIGS. 23A, 23B and 23C illustrate the process in the case where means 22 for relative movement of the containment wall 15 with respect to the support element 21 are provided and in the case where it is desired to drain the pouch. Then, the means 22 for relative movement of the containment wall 15 relative to the support element 21 are switched from the retracted state to the expanded state in such a way as to flatten the flexible 3D pouch 2 and to ensure its complete draining, with the containment wall 15 coming against the lower wall 3 of the rigid container.

The purpose of the invention is also the process in the case where a flexible 3D pouch 2 is selected, with which pouch is structurally combined at least one portion of the containment means 14, in the upper part.

As indicated above, the implementation is quite particularly noteworthy because after the stage in which the holding means 16 are switched from the inactive retracted state to the active expanded state, the rigid container 1 that holds the flexible 3D pouch 2, filled with its contents, is shipped and transported without its integrity being affected, regardless of how full the flexible 3D pouch 2 is.

The invention claimed is:

1. A rigid container for a flexible pouch that is specially designed to contain a biopharmaceutical fluid, comprising:

a lower transverse wall and an erected side peripheral axial wall that limits an upper transverse opening with access to a housing that is defined by an inner surfaces of the lower transverse wall and by an inner surface of the erected side peripheral axial walls, and is able to accommodate the flexible pouch that contains the biopharmaceutical fluid such that said flexible pouch applies against said inner surfaces, containment means that comprise a containment wall, with the containment wall being able to be placed transversely in the housing and having dimensions such that a transverse gap between an outside peripheral free edge of the containment wall and the inner surface of the erected side wall facing opposite the outside peripheral free edge is limited, with the containment wall being able to be applied with a certain axial force against a free upper surface of an upper transverse wall of the pouch and to be held fixed in this position by holding means in an active state, holding means that, in the active state, are applied on the inner surface of the erected side peripheral axial wall so as to hold fixed in position the containment wall that is applied with said certain axial force against the free upper surface of the pouch, wherein the holding means, arranged transversely in the container and borne by the containment means of which they are structurally and functionally part, are movable or deformable in the transverse direction between:

an inactive retracted state in which a distal end part of the holding means is separated from the inner surface of the erected side peripheral axial wall facing opposite said distal end part, and an active expanded state in which said distal end part is applied against said inner surface of the erected side peripheral axial wall in such a way that in the active state of the holding means and of the distal end part, the containment wall is held fixed in position with respect to the walls of the container, and the holding means are able to be applied to any desired location of a continuous zone of the inner surface of the erected side peripheral axial wall, extended in axial direction, in such a way that the containment wall can be placed in the housing at the desired distance from the lower transverse wall or from the upper transverse opening, to be able to be applied and held with a certain axial force against the free transverse upper surface of the pouch regardless of how full the latter is, wherein the containment means comprise—in a lower area—the containment wall and—in an upper area—a support element extended transversely, placed perpendicular to the containment wall, with holding means being borne by said support element, means for rigid connection and transmission of forces being interposed between and combined with the containment wall and the support element, and being able to ensure a rigid connection for transmission of said certain force between the containment wall and the support element, wherein the means for rigid connection and transmission of forces are deformable between two end states, a retracted state and an expanded state, in which, respectively, the containment wall is brought closer to and moved farther from the holding means borne by said support element, with maneuvering means being provided and able to switch the means for rigid connection and transmission of forces between their two end states, whereby these maneuvering means constitute means for relative movement of the containment wall with respect to the support element.

2. The container according to claim 1, wherein the containment wall either is inherently rigid and able to absorb said certain force without substantial deformation or with the containment means then comprising stiffening means that are able, being active, to act on the containment wall to stiffen so that, thus stiffened, the containment wall is able to absorb said certain force with substantial deformation.

3. The container according to claim 1, wherein the containment means are heavy enough and able to exert said certain force against the free upper surface of the pouch by their own weight.

4. The container according to claim 1, wherein the containment means are not able enough in themselves to exert said certain force against the free upper surface of the pouch by their own weight, with the containment means comprising means for application of a force that are able, being active, to act on the containment wall for exerting on it a force such that the containment means in turn exert said certain force against the free upper surface of the pouch.

5. The container according to claim 4, wherein said means for application of a force are manual or human means, a cylinder, or heavy weights.

6. The container according to claim 1, wherein the holding means are borne by the containment wall.

7. The container according to claim 1, wherein the means for rigid connection and transmission of forces are substantially non-deformable.

8. The container according to claim 1, wherein the support element is selected from the group that comprises a plate, a rigid frame or a plate that can be placed transversely in the housing, having dimensions such that the transverse gap between an outside peripheral free edge and the inner surface of the side wall opposite is limited.

9. The container according to claim 1, wherein the means for relative movement that comprise the means for rigid connection and transmission of forces and the maneuvering means are selected from the group consisting of a cylinder, a deformable chamber made more or less flat or more or less expanded by a more or less significant filling with a fluid, equipped with an inlet/outlet port for the filling fluid, filling and draining means being able to be combined with the inlet/outlet port, or a combination of the latter, placed between the containment wall and the support element.

10. The container according to claim 1, wherein an elastically deformable element that is designed to assume the shape of the free upper surface of the pouch is combined with the containment wall.

11. The container according to claim 1, wherein the containment wall comprises one or more holes, cutouts or pipe passages, connections or pipes or the like that are functionally combined with or designed to be functionally combined with the pouch.

12. Process for using a container according to claim 1, comprising:

providing an empty flexible pouch is provided;

placing the empty flexible pouch in the housing of the container in such a way that it can be deployed in the latter;

filling the pouch through an opening to introduce therein a certain quantity of biopharmaceutical fluid, with the pouch thus being at least partially deployed, its side wall being contained by the side wall of the container, and then the opening of the thus filled pouch is closed;

at any time and regardless of how full the pouch is, the containment means, whose holding means are in the inactive retracted state, are brought transversely into the housing of the container, until the containment wall comes against the free transverse upper surface of the pouch and is applied on the free transverse upper surface of the pouch with a certain axial force;

in this situation, the holding means are switched from the inactive retracted state to the active expanded state, and thus the distal end part is locked on the inner surface of the side wall opposite, at any corresponding location of the continuous zone.

13. The process according to claim 12, wherein means for relative movement of the containment wall with respect to the support element are provided, wherein when the containment means are brought into the housing of the container and when the holding means are switched from the inactive retracted state to the active expanded state, the means for relative movement of the containment wall with respect to the flat element are in a retracted state.

14. The process according to claim 12, wherein means for relative movement of the containment wall with respect to the support element are provided, wherein to drain the pouch, the means for relative movement of the containment wall with respect to the support element are switched from the retracted state to the expanded state.

15. The process according to claim 13, wherein means for relative movement of the containment wall with respect to the support element are provided, wherein to drain the pouch, the means for relative movement of the containment wall with respect to the support element are switched from the retracted state to the expanded state.

16. Containment means that comprise a containment wall, with the containment wall being able to be placed transversely in the housing and having dimensions such that a transverse gap between an outside peripheral free edge of the containment wall and an inner surface of an erected side peripheral axial wall facing opposite the outside peripheral free edge is limited, with the containment wall being able to be applied with a certain axial force against a free upper surface of an upper transverse wall of a pouch and to be held fixed in this position by holding means in an active state, holding means that, in the active state, are applicable on the inner surface of the erected side peripheral axial wall so as to hold fixed in position the containment wall that is applied with said certain axial force against the free upper surface of the pouch, wherein the holding means, arranged transversely in the container and borne by the containment means, of which they are structurally and functionally part, are movable or deformable in the transverse direction between:

an inactive retracted state in which a distal end part of these holding means is separated from the inner surface of the erected side peripheral axial wall facing opposite said distal end part, and an active expanded state in which said distal end part is applied against said inner surface of the erected side peripheral axial wall, in such a way that in the active state of the holding means and of their distal end part, the containment wall is held fixed in position with respect to the walls of the container, and the holding means are able to be applied to any desired location of a continuous zone of the inner surface of the erected side peripheral axial wall, extended in axial direction, in such a way that the containment wall can be placed in a housing at a desired distance from a lower transverse wall or from an upper transverse opening, to be able to be applied and held with a certain axial force against the free transverse upper surface of the pouch regardless of how full the latter is, wherein the containment means comprise—in a lower area—the containment wall and—in an upper area—a support element extended transversely, placed perpendicular to the containment wall, with holding means being borne by said support element, means for rigid connection and transmission of forces being interposed between and combined with the containment wall and the support element, and being able to ensure a rigid connection for transmission of said certain force between the containment wall and the support element, wherein the means for rigid connection and transmission of forces are deformable between two end states, a retracted state and an expanded state, in which, respectively, the containment wall is brought closer to and moved farther from the holding means borne by said support element, with maneuvering means being provided and able to switch the means for rigid connection and transmission of forces between their two end states, whereby these maneuvering means constitute means for relative movement of the containment wall with respect to the support element.

* * * * *